US012484739B2

(12) United States Patent
Wang

(10) Patent No.: US 12,484,739 B2
(45) Date of Patent: Dec. 2, 2025

(54) BATHTUB

(71) Applicant: Oriental Recreational Products (Shanghai) Co., Ltd., Shanghai (CN)

(72) Inventor: Zhiyue Wang, Shanghai (CN)

(73) Assignee: Oriental Recreational Products (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 18/689,403

(22) PCT Filed: Dec. 7, 2022

(86) PCT No.: PCT/CN2022/137152
§ 371 (c)(1),
(2) Date: Mar. 5, 2024

(87) PCT Pub. No.: WO2023/116436
PCT Pub. Date: Jun. 29, 2023

(65) Prior Publication Data

US 2025/0000305 A1 Jan. 2, 2025

(30) Foreign Application Priority Data

Dec. 21, 2021 (CN) ..... 202111575816.3

(51) Int. Cl.
*A47K 3/02* (2006.01)

(52) U.S. Cl.
CPC ..... *A47K 3/02* (2013.01)

(58) Field of Classification Search
CPC . A47K 3/02; A47K 3/06; A47K 3/001; A61H 2201/0157; A61H 33/6005; E04H 4/0043
(Continued)

(56) References Cited

U.S. PATENT DOCUMENTS 6,058,521 A 5/2000 O'Brien
11,647,869 B2 * 5/2023 Wesley ..... A47C 7/14 4/579

(Continued)

FOREIGN PATENT DOCUMENTS

AU 2008100588 A4 7/2008
CN 2794398 Y 7/2006

(Continued)

OTHER PUBLICATIONS

International Search Report; China National Intellectual Property Administration; International Application No. PCT/ CN2022/ 137152; Mar. 2, 2023; 9 pages.

*Primary Examiner* — Lori L Baker
(74) *Attorney, Agent, or Firm* — Taft Stettinius & Hollister LLP

(57) ABSTRACT

The present invention discloses a bathtub, including a hard pool body receiving cavity extending in a longitudinal direction, wherein the hard pool body receiving cavity is enclosed by a plurality of fences detachably connected in a circumferential direction and/or the longitudinal direction, and the circumferential direction surrounds the longitudinal direction; and a soft pool body having an opening, including a water receiving cavity and a connecting portion, wherein the water receiving cavity extends along the longitudinal direction, a longitudinal top end of the water receiving cavity has the opening, the connecting portion extends outwardly from the longitudinal top end of the water receiving cavity, the water receiving cavity of the soft pool body is received in the hard pool body receiving cavity, and the connecting portion of the soft pool body is detachably connected to a longitudinal top end of the hard pool body receiving cavity. The bathtub of the present invention can be easily disassembled and stored.

19 Claims, 19 Drawing Sheets

(58) Field of Classification Search
USPC ..... 4/541.3, 541.1, 492, 904
See application file for complete search history.

(56) References Cited

U.S. PATENT DOCUMENTS

| | | | | |
|---|---|---|---|---|
| 12,245,728 | B1 * | 3/2025 | Stander | A47K 3/001 |
| 12,290,215 | B1 * | 5/2025 | Chen | A47K 3/06 |
| 2009/0106889 | A1 * | 4/2009 | Brown | A61H 33/0087 4/541.1 |
| 2018/0192829 | A1 * | 7/2018 | Manchiraju | A61H 33/6005 |
| 2020/0232237 | A1 | 7/2020 | Huang et al. | |

FOREIGN PATENT DOCUMENTS

| | | | | | |
|---|---|---|---|---|---|
| CN | 2857760 | Y | * | 1/2007 | A61H 33/6063 |
| CN | 201110011 | Y | | 9/2008 | |
| CN | 201743583 | U | | 2/2011 | |
| CN | 103603513 | A | | 2/2014 | |
| CN | 205433506 | U | | 8/2016 | |
| CN | 207369697 | U | | 5/2018 | |
| CN | 208892380 | U | | 5/2019 | |
| CN | 209977517 | U | | 1/2020 | |
| CN | 214180225 | U | | 9/2021 | |
| CN | 114129076 | A | | 3/2022 | |
| CN | 114129077 | A | | 3/2022 | |
| CN | 216892679 | U | | 7/2022 | |
| CN | 217066172 | U | | 7/2022 | |
| CN | 217066174 | U | | 7/2022 | |
| CN | 217066183 | U | | 7/2022 | |
| CN | 217066184 | U | | 7/2022 | |
| CN | 217066186 | U | | 7/2022 | |
| CN | 217137821 | U | | 8/2022 | |
| CN | 116725404 | A | * | 9/2023 | A47K 10/48 |
| CN | 119525230 | A | * | 2/2025 | A47K 3/001 |
| EP | 4537804 | A1 | * | 4/2025 | A61H 33/6063 |
| JP | 2002143019 | A | | 5/2002 | |
| KR | 20250065976 | A | * | 5/2025 | A61H 35/00 |

* cited by examiner

BATHTUB

CROSS-REFERENCE TO RELATED APPLICATIONS

This application is a U.S. National Phase of International PCT Application No. PCT/CN2022/137152 filed on Dec. 7, 2022, which claims priority to Chinese Patent Application Serial No. 202111575816.3 filed on Dec. 21, 2021. The contents of those applications are incorporated herein by reference in their entireties.

TECHNICAL FIELD

The present invention relates to the technical field of bathrooms, in particular to a bathtub.

BACKGROUND

In current urban life, due to the fact that the pace of life is fast and working pressure is high, more leisure modes are needed to improve the pleasure of life. A bathtub may make people relax the body and mind and enjoy life during bathing, so that the bathtub is generally welcomed by people. Some bathtubs also have massage and leisure functions. At present, the main types of bathtubs on the market are hard acrylic bathtubs or soft inflatable bathtubs. This makes the bathtubs inconvenient to disassemble and store.

SUMMARY

An object of the present invention is to solve the technical problem that a bathtub is inconvenient to disassemble and store. The present invention provides a bathtub, wherein an outer frame of the bathtub is made of a hard material and a liner is made of a soft material, and thus, the bathtub is convenient to disassemble and store.

To solve the above technical problem, an embodiment of the present invention discloses a bathtub, including a hard pool body receiving cavity extending in a longitudinal direction, wherein the hard pool body receiving cavity is enclosed by a plurality of fences detachably connected in a circumferential direction and/or the longitudinal direction, and the circumferential direction surrounds the longitudinal direction; and a soft pool body having an opening, including a water receiving cavity and a connecting portion, wherein the water receiving cavity extends along the longitudinal direction, a longitudinal top end of the water receiving cavity has the opening, the connecting portion extends outwardly from the longitudinal top end of the water receiving cavity, the water receiving cavity of the soft pool body is received in the hard pool body receiving cavity, and the connecting portion of the soft pool body is detachably connected to a longitudinal top end of the hard pool body receiving cavity.

With the above technical solution, the bathtub includes a hard outer frame and a soft liner. The hard outer frame is enclosed by the plurality of the fences which are detachably connected, and the water receiving cavity of the soft pool body as the soft liner is received in the hard pool body receiving cavity of the hard outer frame, and is detachably connected to the longitudinal top end of the hard pool body receiving cavity through the connecting portion of the soft pool body. In this arrangement, disassembly and storage of the bathtub is facilitated, a floor space is reduced, and transportation is also facilitated.

According to another specific embodiment of the present invention, each fence is made of plastic wood or wood.

According to another specific embodiment of the present invention, the soft pool body is made of PVC or net clamping PVC.

According to another specific embodiment of the present invention, the plurality of the fences include: a first fence, a second fence, a third fence and a fourth fence which are sequentially distributed along the circumferential direction; wherein

- the first fence and the third fence respectively extend along a first direction and are disposed at an interval along a second direction, and the first direction and the second direction are respectively perpendicular to the longitudinal direction;
- the second fence and the fourth fence respectively extend along the second direction and are disposed at an interval along the first direction;
- in the first direction, one longitudinal end of the first fence and one longitudinal end of the second fence are detachably connected by a first corner beam, the other longitudinal end of the first fence and one longitudinal end of the fourth fence are detachably connected by a second corner beam, and the first corner beam and the second corner beam extend along the longitudinal direction, respectively; and
- in the first direction, one longitudinal end of the third fence and the other longitudinal end of the second fence are detachably connected by a third corner beam, the other longitudinal end of the third fence and the other longitudinal end of the fourth fence are detachably connected by a fourth corner beam, and the third corner beam and the fourth corner beam extend along the longitudinal direction, respectively.

According to another specific embodiment of the present invention, the first direction, the second direction and the longitudinal direction are perpendicular to each other.

According to another specific embodiment of the present invention, each of the fences includes: an upper transverse beam, a lower transverse beam, a connecting plate and a plurality of vertical beams; wherein

- the upper transverse beam and the lower transverse beam are disposed at an interval along the longitudinal direction, and extend in a direction perpendicular to the longitudinal direction, respectively;
- the plurality of the vertical beams extend along the longitudinal direction, respectively, and are connected with the upper transverse beam and the lower transverse beam, respectively; and
- the connecting plate extends in the same direction as those of the upper transverse beam and the lower transverse beam, is located between the upper transverse beam and the lower transverse beam in the longitudinal direction, and is connected to the upper transverse beam, the lower transverse beam, and the vertical beams.

According to another specific embodiment of the present invention, the vertical beams at both ends of each fence are detachably connected to the corresponding corner beams, respectively.

According to another specific embodiment of the present invention, each vertical beam is of a hollow structure, a first blocking block is received at one longitudinal end of each vertical beam, a second blocking block is received at the other longitudinal end of the vertical beam, the upper transverse beam is connected to the vertical beams by the first blocking blocks, and the lower transverse beam is connected to the vertical beams by the second blocking blocks.

According to another specific embodiment of the present invention, an outer circumferential surface of each of the first blocking blocks and the second blocking blocks is provided with anti-slip structures in a protruding manner for abutting against an inner wall of the corresponding vertical beam after each blocking block is placed in the corresponding vertical beam, and no relative movement of each blocking block and the corresponding vertical beam in the longitudinal direction occurs when no external force is applied to each blocking block.

According to another specific embodiment of the present invention, each blocking block is in concave-convex fit with an inner wall of the corresponding vertical beam.

According to another specific embodiment of the present invention, each blocking block is fixedly connected to the inner wall of the corresponding vertical beam at a concave-convex fit position by screws.

According to another specific embodiment of the present invention, the upper transverse beam of each fence is in concave-convex fit with the connecting portion of the soft pool body.

According to another specific embodiment of the present invention, the bathtub further includes: positioning members, wherein each corner beam is provided with one of the positioning members, each positioning member is provided with a positioning post in a protruding manner, and a portion, corresponding to each corner beam, of the connecting portion of the soft pool body sleeves the corresponding positioning post.

According to another specific embodiment of the present invention, each corner beam is of a hollow structure, each positioning member includes a tubular structure, and each tubular structure is inserted into the corresponding corner beam.

According to another specific embodiment of the present invention, each positioning member further includes a first extension extending toward and fixedly connected to one of grooves of the adjacent upper transverse beams, and a second extension extending toward and fixedly connected to the other groove of the grooves of the adjacent upper transverse beams.

According to another specific embodiment of the present invention, each positioning member further includes a third extension that is clamped between the adjacent fences.

According to another specific embodiment of the present invention, each positioning post is provided with a connecting hole for being fixedly connected with a cover plate assembly for covering the connecting portion of the soft pool body.

According to another specific embodiment of the present invention, the cover plate assembly includes: a first cover plate, a second cover plate, a third cover plate and a fourth cover plate which are sequentially distributed along the circumferential direction; wherein the first cover plate and the third cover plate extend along the first direction, respectively, the second cover plate and the fourth cover plate extend along the second direction, respectively, the first cover plate covers an upper transverse beam of the first fence, the second cover plate covers an upper transverse beam of the second fence, the third cover plate covers an upper transverse beam of the third fence, and the fourth cover plate covers an upper transverse beam of the fourth fence;

in the first direction, one end of the first cover plate and one end of the second cover plate are detachably connected through a first transition piece, and the other end of the first cover plate and one end of the fourth cover plate are detachably connected through a second transition piece;

in the first direction, one end of the third cover plate and the other end of the second cover plate are detachably connected through a third transition piece, and the other end of the third cover plate and the other end of the fourth cover plate are detachably connected through a fourth transition piece;

the first transition piece covers the positioning member on the first corner beam, and is fixedly connected with a connecting hole in the positioning post on the first corner beam;

the second transition piece covers the positioning member on the second corner beam, and is fixedly connected with a connecting hole in the positioning post on the second corner beam;

the third transition piece covers the positioning member on the third corner beam, and is fixedly connected with a connecting hole in the positioning post on the third corner beam; and the fourth transition piece covers the positioning member on the fourth corner beam, and is fixedly connected with a connecting hole in the positioning post on the fourth corner beam.

According to another specific embodiment of the present invention, each cover plate is connected with the corresponding transition piece in an insertion manner.

According to another specific embodiment of the invention, both ends of an extension direction of each cover plate each are provided with an insertion hole, each transition piece is provided with a first insertion portion and a second insertion portion, each first insertion portion is inserted into one of insertion holes of the adjacent cover plates, and each second insertion portion is inserted into the other insertion hole of the insertion holes of the adjacent cover plates.

According to another specific embodiment of the present invention, the surface of each first insertion portion and the surface of each second insertion portion each are provided with a second detachment prevention portion for abutting against an inner wall of the corresponding insertion hole after each insertion portion is inserted into the corresponding insertion hole, and no relative movement of each insertion portion and the corresponding insertion hole in an insertion direction occurs when no external force is applied to each second detachment prevention portion.

According to another specific embodiment of the present invention, the bathtub further includes a pipeline assembly for water inlet and drainage, wherein at least a portion of the pipeline assembly is received between the soft pool body and the hard pool body receiving cavity.

According to another specific embodiment of the present invention, the pipeline assembly includes a water inlet pipeline and a water outlet pipeline; one end of the water inlet pipeline is connected with the soft pool body, and the other end of the water inlet pipeline is connected with a control box; and one end of the water outlet pipeline is connected with the soft pool body, and the other end of the water outlet pipeline is connected with the control box; wherein the water inlet pipeline includes a soft water inlet pipeline, and a first hard water inlet pipeline and a second hard water inlet pipeline which are located at two ends of the soft water inlet pipeline, the first hard water inlet pipeline is connected with the soft pool body, and the second hard water inlet pipeline is connected with the control box; and the water outlet pipeline includes a soft water outlet pipeline, and a first hard water outlet pipeline and a second hard water outlet pipeline which are located at two ends of the soft water outlet pipeline, the first hard water outlet pipeline is connected with the soft pool body, and the second hard water outlet pipeline is connected with the control box.

According to another specific embodiment of the present invention, the soft water inlet pipeline or the soft water outlet pipeline is provided with a hard support structure.

According to another specific embodiment of the present invention, a water inlet division pipe is arranged between the soft pool body and the hard pool body receiving cavity, the water inlet branch pipe includes a plurality of multiway hard pipes and hoses, the adjacent multiway hard pipes are connected by one of the hoses, and each multiway hard pipe is provided with a plurality of nozzles.

According to another specific embodiment of the present invention, the pipeline assembly includes hard pipelines and soft pipelines, an end where each hard pipeline is connected with the corresponding soft pipeline is provided with an external thread structure surrounding the hard pipeline, each external thread structure is connected with the corresponding hard pipeline through a limit stop, and each limit stop, the corresponding external thread structure and the corresponding hard pipeline enclose a waterproof cavity with an end opened; and an outer periphery of each soft pipeline is sleeved with a tapered press ring and a locking nut, each soft pipeline is inserted into the corresponding waterproof cavity, each locking nut is threadably connected with the corresponding external thread structure, in an insertion direction of each soft pipeline, the corresponding tapered press ring is located between an end of the corresponding external thread structure and the corresponding locking nut, and each tapered press ring and an end of the corresponding hard pipeline clamp the corresponding soft pipeline in the insertion direction.

DETAILED DESCRIPTION

Figure 1:
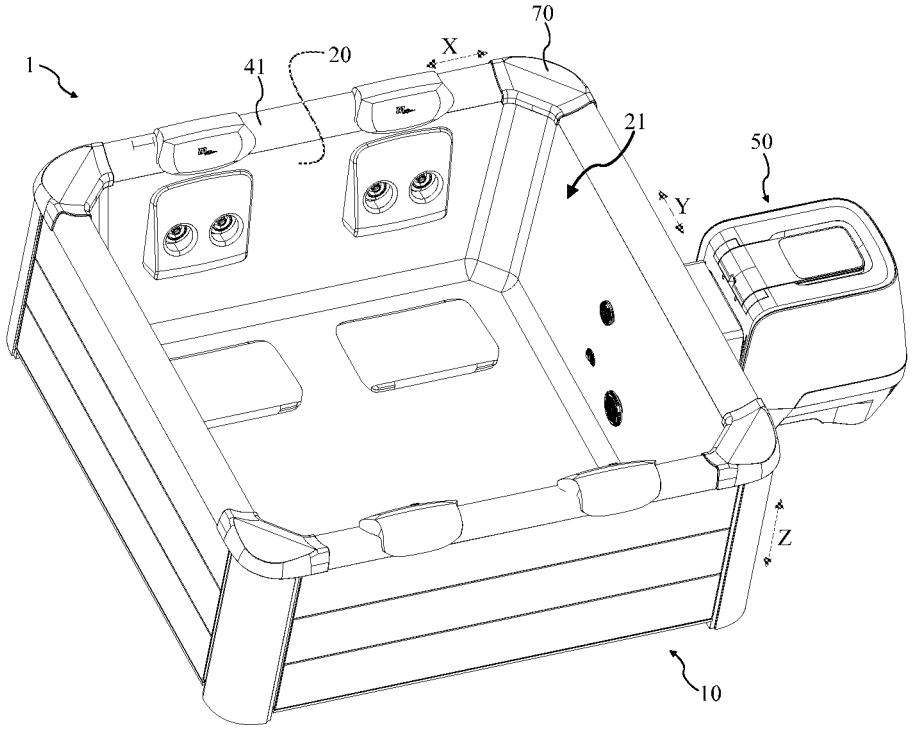
FIG. 1 illustrates a first perspective view of a pool body according to an embodiment of the present invention.

Implementation modes of the present invention are illustrated below by specific embodiments, and those skilled in the art can easily understand other advantages and effects of the present invention according to the content disclosed in the specification. Although the description of the present invention will be introduced in conjunction with preferred embodiments, this does not represent that the features of the present invention are only limited to the embodiments. On the contrary, the description of the present invention in conjunction with the implementation modes is intended to cover other alternatives or modifications that may be extended based on the claims of the present invention. In order to thoroughly understand the present invention, the following description will contain many specific details. The present invention may also be implemented without using these details. In addition, in order to avoid confusing or obscuring the key point of the present invention, some specific details are omitted in the description. It should be noted that the embodiments of the present invention and the features in the embodiments may be combined with each other without conflicts.

It should be noted that in this description, like reference numerals and letters denote like items in the following figures, and therefore, once an item is defined in one figure, it needs not be further defined and explained in the following figures.

In the description of this embodiment, it should be noted that the terms "upper", "lower", "inner", "bottom" and the like indicate an orientation or positional relationship based on the orientation or positional relationship shown in the drawings, or the orientation or positional relationship in which the product of the invention is conventionally placed in use, and are merely for ease of description of the invention and for simplicity of description, and are not intended to indicate or imply that the device or element referred to must have a particular orientation, and be constructed and operated in a particular orientation, and therefore cannot to be construed as limiting the invention.

The terms "first," "second," and the like are used only to distinguish descriptions and are not to be construed as indicating or implying relative importance.

In the description of this embodiment, it should also to be noted that the terms "arranged", "connected" and "connection" should be broadly understood unless expressly specified and defined otherwise, for example, it can be fixed connection, detachable connection or integrated connection; it can be mechanical connection or electric connection; and it can be direct connection or indirect connection through an intermediate medium, and may be internal communication of two elements. For those of ordinary skill in the art, the specific meaning of the above terms in this embodiment may be understood according to specific situations.

In order to make the objective, the technical solutions and the advantages of the present invention clearer, the implementation modes of the present invention are further described in detail in combination with the accompanying drawings.

Figure 2:
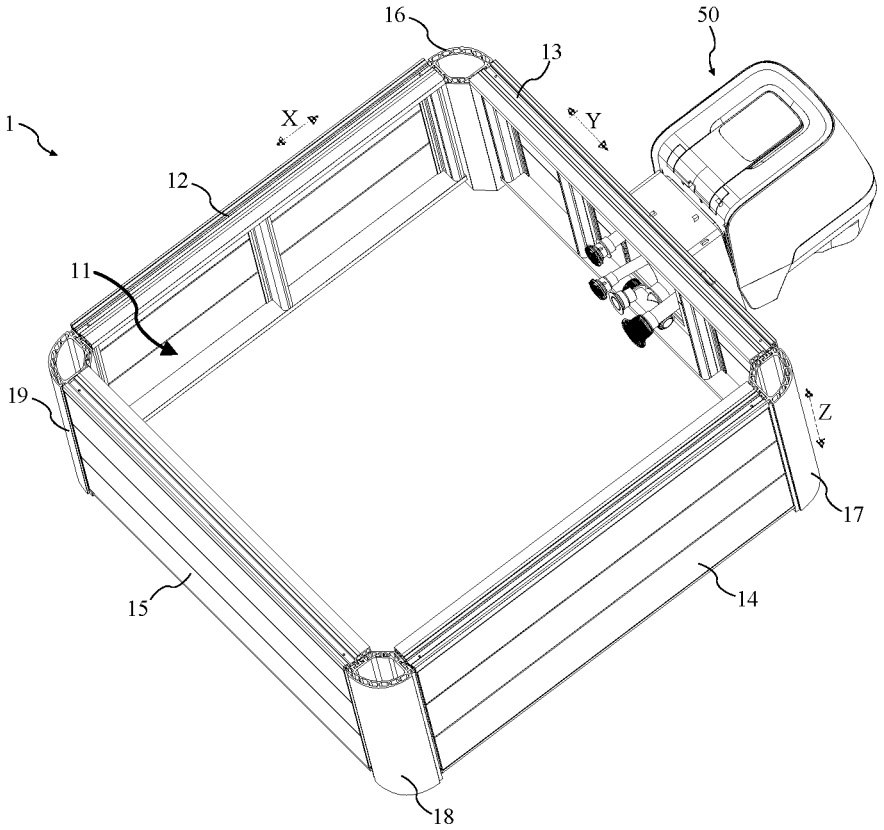
FIG. 2 illustrates a second perspective view of the pool body according to the embodiment of the present invention.
Figure 3:
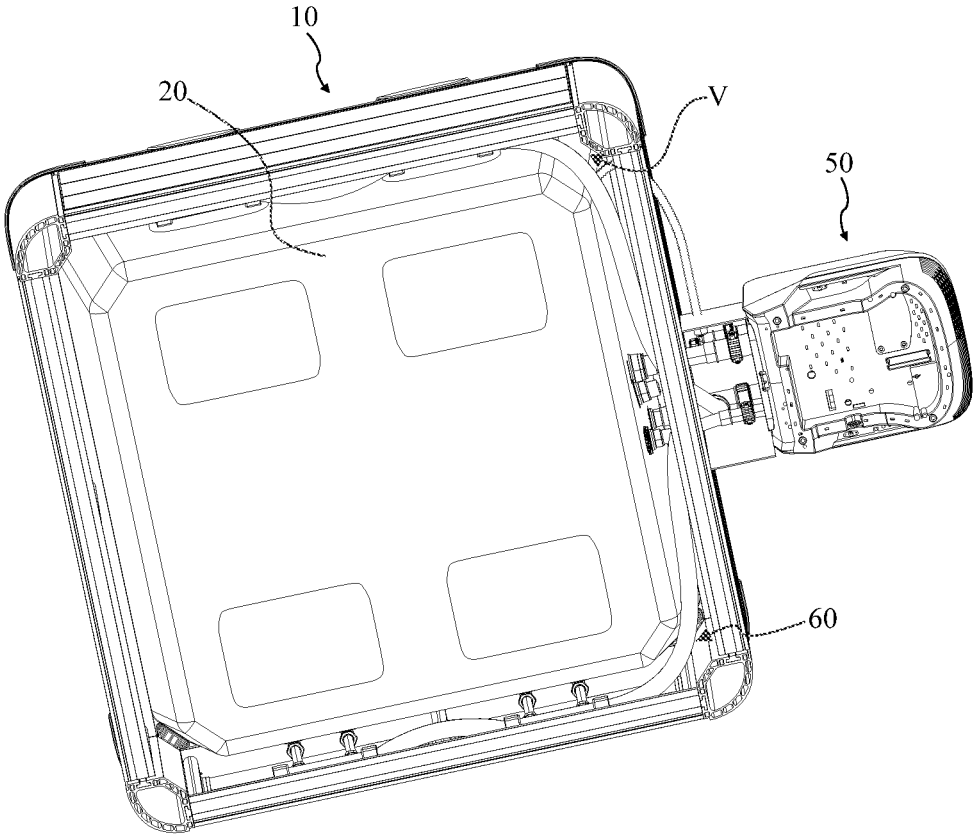
FIG. 3 illustrates a third perspective view of the pool body according to the embodiment of the present invention.

Referring to FIGS. 1 to 15, the present application provides a pool body 1, and the present application is illustrated by taking the condition that the pool body 1 is a bathtub as an example. The bathtub includes an outer frame 10 and a liner (a pool body described later). Wherein the outer frame 10 is made of a hard material, and the liner is made of a soft material. The outer frame 10 includes a hard pool body receiving cavity 11 which is made of a hard material and used for receiving a soft pool body 20 described later. The shape of the hard pool body receiving cavity 11 shown in FIG. 2 is a square shape, but the shape of the hard pool body receiving cavity 11 is not limited in the present application as long as the hard pool body receiving cavity 11 can receive the soft pool body 20 described later. For example, in some possible embodiments, the shape of the hard pool body receiving cavity 11 is a round shape, a pentagonal shape, a hexagonal shape, an octagonal shape, or the like.

The hard pool body receiving cavity 11 extends in a longitudinal direction (shown in a Z direction in FIGS. 1, 2 and 4), the hard pool body receiving cavity 11 is enclosed by a plurality of fences detachably connected in a circumferential direction and/or the longitudinal direction, and the circumferential direction surrounds the longitudinal direction. That is, the plurality of the fences are detachably connected in the circumferential direction to enclose the hard pool body receiving cavity 11; or, the plurality of the fences are detachably connected in the longitudinal direction to enclose the hard pool body receiving cavity 11; or, the plurality of the fences are detachably connected in the circumferential direction and detachably connected in the longitudinal direction to enclose the hard pool body receiving cavity 11. The present application is illustrated by taking the condition that the plurality of the fences are detachably connected in the circumferential direction and detachably connected in the longitudinal direction to enclose the hard pool body receiving cavity 11 as an example, as described in detail below.

Figure 4:
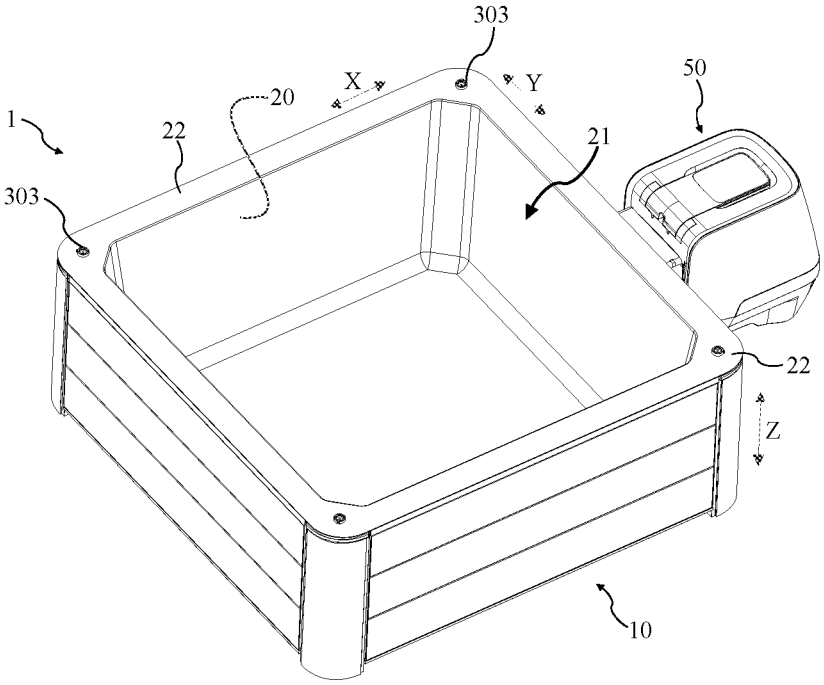
FIG. 4 illustrates a fourth perspective view of the pool body according to the embodiment of the present invention.

The liner is a soft pool body 20 having an opening, and the soft pool body 20 includes a water receiving cavity 21 (for storing water) and a connecting portion 22, wherein the water receiving cavity 21 extends along the longitudinal direction, a longitudinal top end of the water receiving cavity 21 has the opening, and the connecting portion 22 extends outwardly from the longitudinal top end of the water receiving cavity 21. That is, an inner wall of the bathtub is made of a single layer of soft material. The water receiving cavity 21 of the soft pool body 20 is received in the hard pool body receiving cavity 11, and the connecting portion 22 of the soft pool body 20 is detachably connected to a longitudinal top end of the hard pool body receiving cavity 11. The shape of the water receiving cavity 21 shown in FIGS. 1 and 4 is a quadrilateral shape, but the shape of the water receiving cavity 21 is not limited in the present application as long as the water receiving cavity 21 can be received in the hard pool body receiving cavity 11. For example, in some possible embodiments, the shape of the water receiving cavity 21 is a round shape, a pentagonal shape, a hexagonal shape, an octagonal shape, or the like.

Thus, the present application provides a detachable bathtub including a hard outer frame 10 and a soft liner. The hard outer frame 10 is enclosed by the plurality of the fences which are detachably connected, and the water receiving cavity 21 of the soft pool body 20 as the soft liner is received in the hard pool body receiving cavity 11 of the hard outer frame 10, and is detachably connected to the longitudinal top end of the hard pool body receiving cavity 11 through the connecting portion 22 of the soft pool body 20. In this arrangement, disassembly and storage of the bathtub is facilitated, a floor space is reduced, and transportation is also facilitated.

In addition, since the detachable bathtub uses the hard outer frame 10 and the soft liner, the hard outer frame 10 plays a supporting role after the soft pool body 20 as the soft liner is filled with water. For example, the longitudinal top end of the hard pool body receiving cavity 11 supports the water receiving cavity of the soft pool body 20 by supporting the connecting portion 22 of the soft pool body 20.

Exemplarily, each fence is made of plastic wood or wood. At present, outer frames of bathtubs on the market use acrylic, inflatable bags, metal frames or concrete structures. The outer frame 10 of the bathtub of the present application adopts plastic wood fences instead of the conventional acrylic, inflatable bags, metal frames and the like. The bathtub is beautiful as a whole.

Exemplarily, the soft pool body 20 is made of PVC or net clamping PVC. By selecting the net clamping PVC and PVC leather, the water pressure bearing requirements are met.

In some possible embodiments, referring to FIG. 2, in the longitudinal direction, both ends of the hard pool body receiving cavity 11 each are provided with an opening. After the water receiving cavity 21 is received in the hard pool body receiving cavity 11 of the hard outer frame 10, a longitudinal bottom end of the water receiving cavity 21 can be supported by the ground when the bathtub is placed on the ground. This is equivalent to that the hard pool body receiving cavity 11 enclosed by the plurality of the fences and the ground together support the water receiving cavity 21 of the soft pool body 20. No additional structural parts are required to support the water receiving cavity 21, thus saving the cost.

As described above, the present application is illustrated by taking the condition that the plurality of the fences are detachably connected in the circumferential direction and detachably connected in the longitudinal direction to enclose the hard pool body receiving cavity 11 as an example.

In some possible embodiments, with reference to FIGS. 2, and 5 to 9, the plurality of the fences include a first fence 12, a second fence 13, a third fence 14 and a fourth fence 15 which are sequentially distributed along the circumferential direction. Wherein the first fence 12 and the third fence 14 respectively extend along a first direction (shown in an X direction in FIGS. 2 and 8) and are disposed at an interval along a second direction (shown in a Y direction in FIGS. 2 and 8), and the first direction and the second direction are respectively perpendicular to the longitudinal direction. The second fence 13 and the fourth fence 15 respectively extend along the second direction and are disposed at an interval in the first direction. Exemplarily, the first direction, the second direction and the longitudinal direction are perpendicular to each other. Thus, the plurality of the fences enclose the hard pool body receiving cavity 11 of a quadrilateral shape.

In the first direction, one longitudinal end of the first fence 12 and one longitudinal end of the second fence 13 are detachably connected by a first corner beam 16, the other longitudinal end of the first fence 12 and one longitudinal end of the fourth fence 15 are detachably connected by a second corner beam 17, and the first corner beam 16 and the second corner beam 17 extend along the longitudinal direction, respectively; and in the first direction, one longitudinal end of the third fence 14 and the other longitudinal end of the second fence 13 are detachably connected by a third corner beam 18, the other longitudinal end of the third fence 14 and the other longitudinal end of the fourth fence 15 are detachably connected by a fourth corner beam 19, and the third corner beam 18 and the fourth corner beam 19 extend along the longitudinal direction, respectively.

That is, in the circumferential direction, the first fence 12, the first corner beam 16, the second fence 13, the second corner beam 17, the third fence 14, the third corner beam 18, the fourth fence 15 and the fourth corner beam 19 are detachably connected to enclose the hard outer frame 10 of the bathtub as a whole to accommodate the soft pool body 20. In this arrangement, the mounting is convenient and the circumferential connection is reliable.

Figure 8:
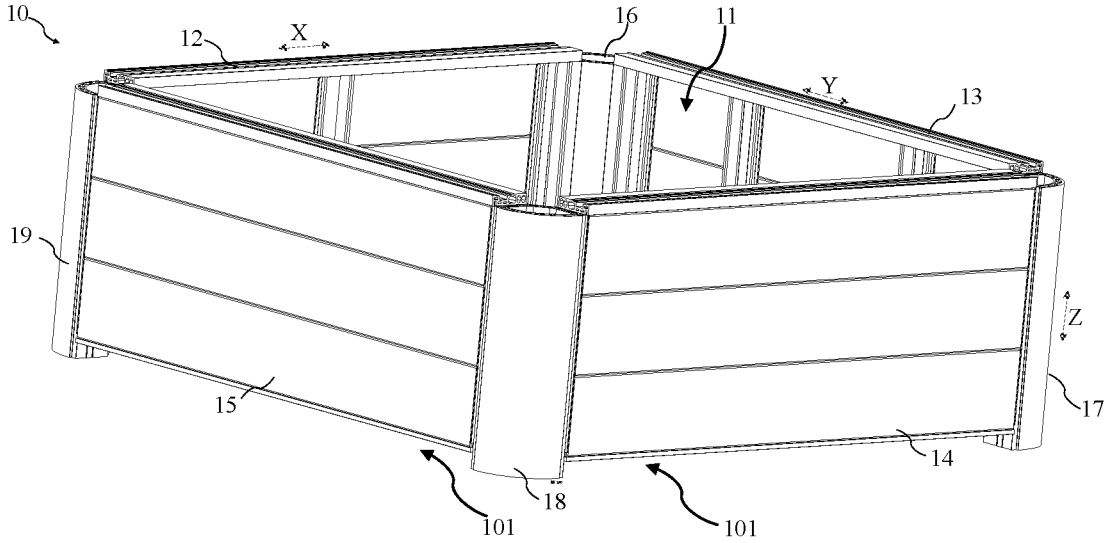
FIG. 8 illustrates a fifth perspective view of the pool body according to the embodiment of the present invention.

Exemplarily, with reference to FIG. 8, in the longitudinal direction, the bottom of the hard outer frame 10 has a light-transmissive structure 101. Exemplarily, as shown in FIG. 8, each fence is higher than each corner beam in the longitudinal direction to form four light-transmissive structures 101 as described above. That is, each side of the circumference of the hard outer frame 10 is provided with the light-transmissive structure 101. Each corner beam (the first corner beam 16, the second corner beam 17, the third corner beam 18, and the fourth corner beam 19) is in contact with the ground, and each fence (the first fence 12, the second fence 13, the third fence 14, and the fourth fence 15) is longitudinally spaced from the ground to form the light-transmissive structures 101 described above. In some possible embodiments, one or two or three sides of the circumference of the hard outer frame 10 are provided with the light-transmissive structure 101.

The light-transmissive structures 101 expose the soft pool body 20 received in the hard pool body receiving cavity 11, and light-emitting elements (not shown) are arranged at positions, corresponding to the light-transmissive structures 101, of the outer surface of the soft pool body 20. That is, the light-emitting elements arranged on the outer surface of the soft pool body 20 can be seen by a user at the light-transmissive structures 101 of the hard outer frame 10. The light-emitting elements emit light after being energized, and are displayed at the positions of the light-transmissive structures 101, which enhances the user experience and increases interestingness.

Figure 5:
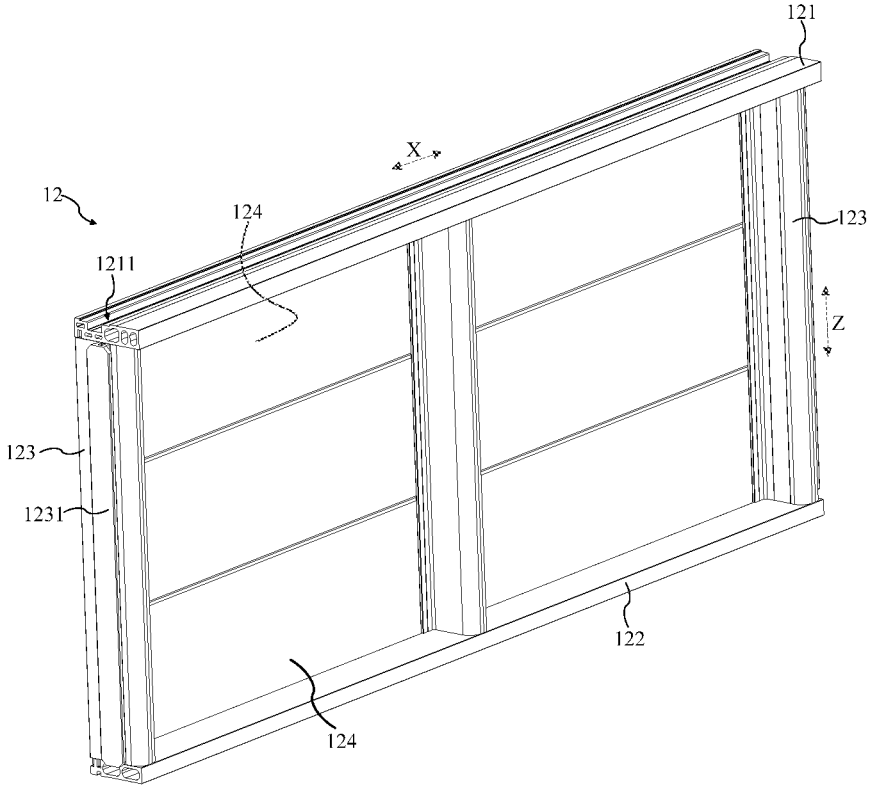
FIG. 5 illustrates a first perspective view of a fence in the pool body according to the embodiment of the present invention.
Figure 6:
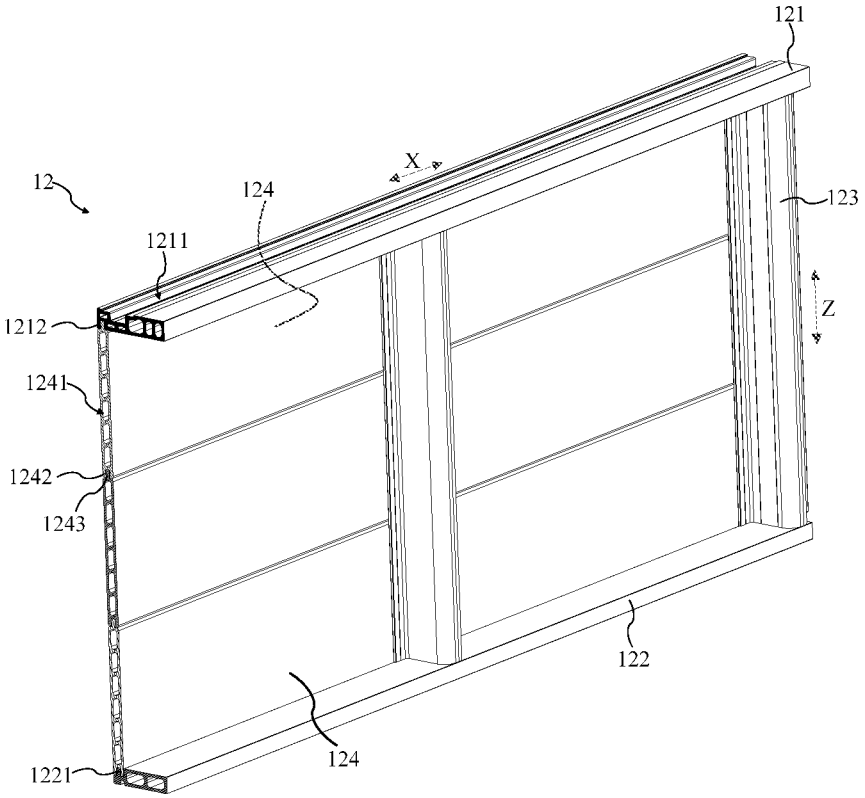
FIG. 6 illustrates a second perspective view of the fence in the pool body according to the embodiment of the present invention.

Exemplarily, the structures of the four fences (the first fence 12, the second fence 13, the third fence 14 and the fourth fence 15) of the present application are the same. Referring to FIGS. 5 and 6, hereinafter, description is made by taking the structure of the first fence 12 as an example, and the structures of the remaining fences refer to the description of the structure of the first fence 12.

The first fence 12 includes an upper transverse beam 121, a lower transverse beam 122, a connecting plate 124, and a plurality of vertical beams 123. Accordingly, the second fence 13, the third fence 14, and the fourth fence 15 each include an upper transverse beam 121, a lower transverse beam 122, a connecting plate 124, and a plurality of vertical beams 123. Description is made by taking the structure of the first fence 12 as an example. Wherein the upper transverse beam 121 of the first fence 12 and the lower transverse beam 122 of the first fence 12 are disposed at an interval along the longitudinal direction (shown in a Z direction in FIGS. 5 and 6), and extend in a direction perpendicular to the longitudinal direction, respectively, and the upper transverse beam 121 and the lower transverse beam 122 of the first fence 12 shown in FIGS. 5 and 6 respectively extend along the first direction (shown in the X direction in FIGS. 5 and 6). The plurality of the vertical beams 123 of the first fence 12 extend along the longitudinal direction, respectively, and are connected with the upper transverse beam 121 and the lower transverse beam 122, respectively. The first fence 12 shown in FIG. 5 includes three vertical beams 123, which are arranged at intervals along the extension direction of the first fence 12. Two vertical beams 123 at both ends of the extension direction of the first fence 12 are configured to be detachably connected to the corresponding corner beams, respectively, as will be described in detail later.

The number of the vertical beams 123 of the first fence 12 is not limited, and in other embodiments, the number of the vertical beams 123 of the first fence 12 is, for example, two, four, or the like.

The connecting plate 124 of the first fence 12 described above extends in the same direction as those of the upper transverse beam 121 of the first fence 12 and the lower transverse beam 122 of the first fence 12, that is, the connecting plate 124 of the first fence 12 extends in a direction perpendicular to the longitudinal direction; that is, the connecting plate 124 of the first fence 12 is parallel to the upper transverse beam 121 of the first fence 12 and the lower transverse beam 122 of the first fence 12, respectively. In addition, the connecting plate 124 of the first fence 12 is longitudinally positioned between the upper transverse beam 121 and the lower transverse beam 122, and is connected to the upper transverse beam 121, the lower transverse beam 122, and the vertical beams 123. That is, the first fence 12 is formed by connecting the upper transverse beam 121, the lower transverse beam 122, the plurality of the vertical beams 123, and the connecting plate 124.

Exemplarily, with continued reference to FIGS. 5 and 6, the first fence 12 has three connecting plates 124 in the longitudinal direction, and adjacent connecting plates 124 overlap in the longitudinal direction such that the first fence 12 is detachably connected in the longitudinal direction. For example, three connecting plates 124 are overlapped in the longitudinal direction, and detachably connected to the upper transverse beam 121, the lower transverse beam 122 and the plurality of the vertical beams 123, respectively. The number of the connecting plates 124 of the first fence 12 described above is not limited to being three, and in some possible embodiments, the number of the connecting plates 124 of the first fence 12 is, for example, one, two, four, or the like.

Referring to FIG. 6, adjacent connecting plates 124 are detachably connected by a mortise and tenon structure. The connecting plates 124 are connected to the upper transverse beam 121 and the lower transverse beam 122 by mortise and tenon structures, respectively. Exemplarily, in the longitudinal direction, each connecting plate 124 of the first fence 12 is provided with connecting protrusions 1243 at the upper end thereof, and is provided with connecting recesses 1242 at the lower end thereof, transverse beam connecting recesses 1212 are formed in one side, facing the connection plates 124, of the upper transverse beam 121 of the first fence 12, and transverse beam connecting protrusions 1221 are arranged at one side, facing the connecting plates 124, of the lower transverse beam 122 of the first fence 12. The adjacent connecting plates 124 are detachably connected through the connecting protrusions 1243 and the connecting recesses 1242, the upper transverse beam 121 of the first fence 12 is detachably connected through the transverse beam connecting recesses 1212 and the connecting protrusions 1243 of the upper end of the connecting plate 124, and the lower transverse beam 122 of the first fence 12 is detachably connected through the transverse beam connecting protrusions 1221 and the connecting recesses 1242 of the lower end of the connecting plate 124.

The mortise and tenon structure between the connecting plates 124 is not limited thereto, and the mortise and tenon structure between the connecting plate 124 and the upper transverse beam 121 and the mortise and tenon structure between the connecting plate 124 and the lower transverse beam 122 are not limited thereto in the present application, and mortise and tenon structures capable of realizing detachable connection all belong to the protection scope of the present application.

Referring to FIG. 6, each connecting plate 124 of the first fence 12 is of a hollow structure 1241 to accommodate a portion of connecting pieces between the connecting plates 124 and the vertical beams 123. Exemplarily, the connecting plates 124 of the first fence 12 and the vertical beams 123 are connected by screws, so that after the connecting plates 124 and the vertical beams 123 are connected together by the screws, the heads of the screws will be accommodated in the hollow structures 1241 of the connecting plates 124. Thus, the hollow structures of the first fence 12 function to receive the heads of the screws while realizing the weight reduction of the first fence 12, so that the structure of the fence is compact.

As described previously, the two vertical beams 123 at both ends of the extension direction of the first fence 12 are configured to be detachably connected to the corresponding corner beams, respectively. As shown in connection with FIG. 2, two vertical beams 123 at both ends of the extension direction of the first fence 12 are configured to be detachably connected to the first corner beam 16 and the fourth corner beam 19, respectively, two vertical beams 123 at both ends of the extension direction of the second fence 13 are configured to be detachably connected to the first corner beam 16 and the second corner beam 17, respectively, two vertical beams 123 at both ends of the extension direction of the third fence 14 are configured to be detachably connected to the second corner beam 17 and the third corner beam 18, respectively, and two vertical beams 123 at both ends of the extension direction of the fourth fence 15 are configured to be detachably connected to the third corner beam 18 and the fourth corner beam 19, respectively.

Referring to FIG. 5, description is made by taking the structures of the vertical beams 123 of the first fence 12 as an example. The vertical beams 123 at both ends of the first fence 12 each are provided with a T-shaped clamping block 1231, the T-shaped clamping blocks 1231 extend in the longitudinal direction, and the corresponding corner beams are provided with clamping slots 161 that are matched with the T-shaped clamping blocks 1231 to achieve detachable connection of the vertical beams 123 with the corresponding corner beams. The vertical beam 123 in the middle between the vertical beams 123 at both ends of the first fence 12 is not provided with a T-shaped clamping block 1231. That is, the first corner beam 16 and the fourth corner beam 19 at both ends of the extension direction of the first fence 12 are respectively provided with the clamping slots 161 that are matched with the T-shaped clamping blocks 1231 on the vertical beams 123 at both ends of the first fence 12. The structure of each corner beam is the same, and with reference to FIG. 7, description is made by taking the structure of the first corner beam 16 as an example. One side, facing the vertical beam 123 at one side of the first fence 12, of the first corner beam 16 is provided with a clamping slot 161 matched with the T-shaped clamping block 1231, and one side, facing the vertical beam 123 at one side of the second fence 13, of the first corner beam 16 is provided with a clamping slot 161 matched with the T-shaped clamping block 1231.

Figure 15:
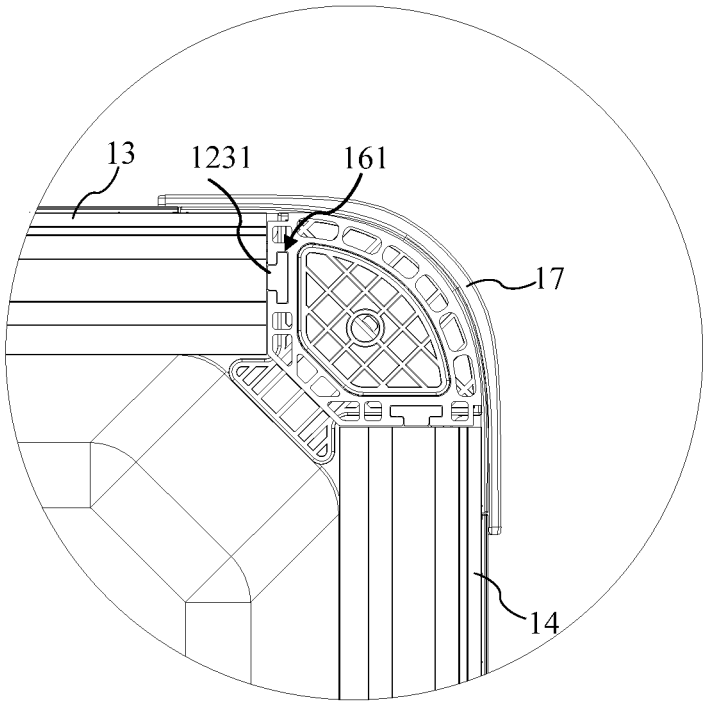
FIG. 15 illustrates an enlarged partial view of the pool body according to the embodiment of the present invention.

That is, the first corner beam 16 is provided with two clamping slots 161 extending in the longitudinal direction, and each clamping slot 161 is in snap fit with the corresponding T-shaped clamping block 1231 on the vertical beam 123 of the corresponding fence (the first fence 12 and the second fence 13) (referring to FIG. 15). Correspondingly, the second corner beam 17 is provided with two clamping slots 161 extending in the longitudinal direction, and each clamping slot 161 is in snap fit with the corresponding T-shaped clamping block 1231 on the vertical beam 123 of the corresponding fence (the second fence 13 and the third fence 14). The third corner beam 18 is provided with two clamping slots 161 extending in the longitudinal direction, and each clamping slot 161 is in snap fit with the corresponding T-shaped clamping block 1231 on the vertical beam 123 of the corresponding fence (the third fence 14 and the fourth fence 15). The fourth corner beam 19 is provided with two clamping slots 161 extending in the longitudinal direction, and each clamping slot 161 is in snap fit with the corresponding T-shaped clamping block 1231 on the vertical beam 123 of the corresponding fence (the first fence 12 and the fourth fence 15). In this arrangement, detachable connection between each fence and the corresponding corner beam is facilitated.

Figure 7:
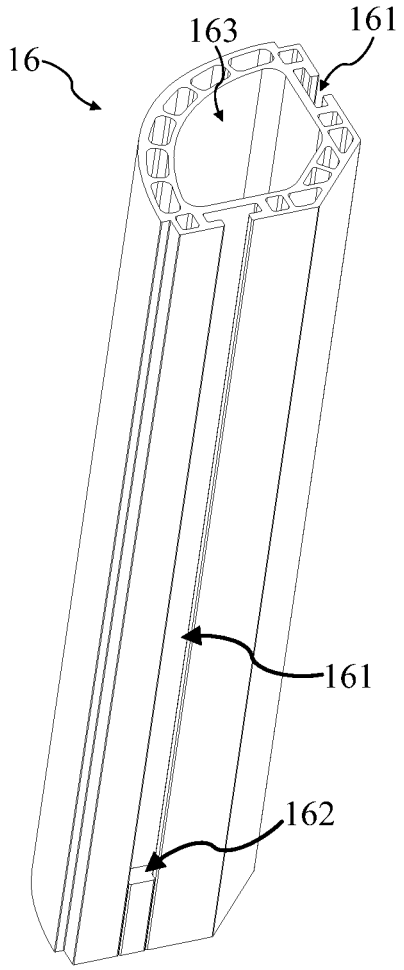
FIG. 7 illustrates a perspective view of a corner beam in the pool body according to the embodiment of the present invention.

With continued reference to FIG. 7, the bottom of each clamping slot 161 of the first corner beam 16 is provided with a support portion 162. After this arrangement, on one hand, after the T-shaped clamping blocks 1231 on the vertical beams 123 of the corresponding fences (the first fence 12 and the second fence 13) are inserted into the clamping slots 161 in the longitudinal direction from upper right to bottom to be in snap fit, the corresponding fences are supported by the support portions 162; on the other hand, the support portions 162 support the corresponding fences so that the fences are higher than the corner beams to form the light-transmissive structures 101 as described above.

Figure 16:
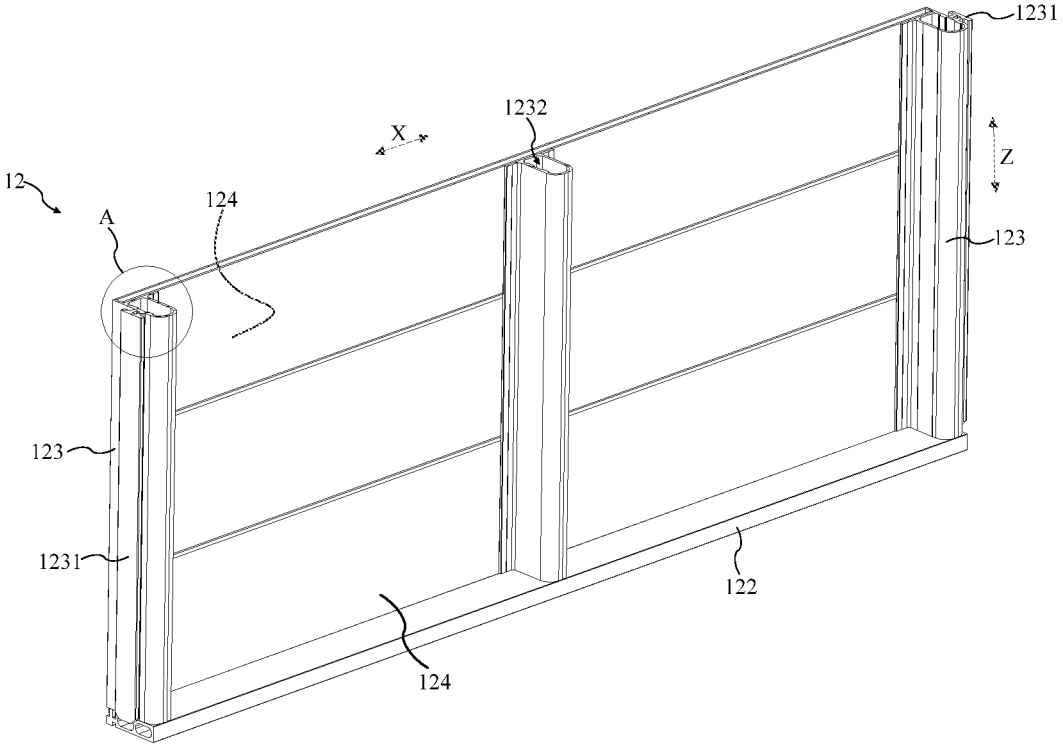
FIG. 16 illustrates a third perspective view of the fence in the pool body according to the embodiment of the present invention.
Figure 17:
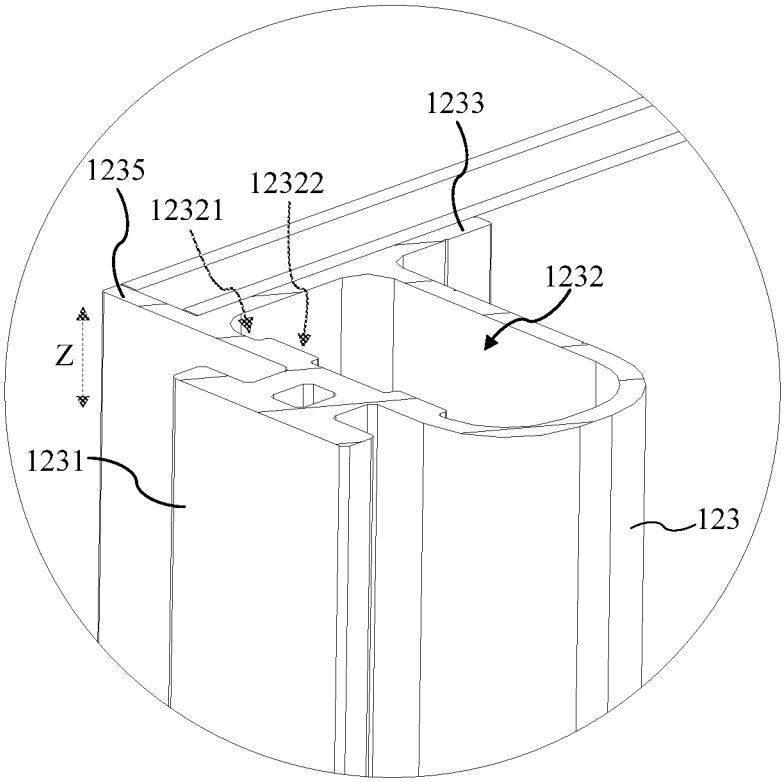
FIG. 17 shows an enlarged view of a portion A in FIG. 16.

Referring to FIGS. 16 and 17, the vertical beams 123 at the right and left ends in the extension direction of the first fence 12 each are provided with a first flange 1233 and a second flange 1235 extending in the longitudinal direction, the first flanges 1233 are fitted to and connected with a portion, facing the soft pool body 20, of the connecting plate 124, and the second flanges 1235 are fitted to and connected with one end in the extension direction of the connecting plate 124. The first flanges 1233 of the vertical beams 123 at both ends of the first fence 12 are located on the same side of the first fence 12 (one side, facing the soft pool body 20, of the connecting plate 124), and the second flanges 1235 of the vertical beams 123 at both ends of the first fence 12 are located on opposite sides of the extension direction of the connecting plate 124. After the first flanges 1233 and the second flanges 1235 are arranged, the two vertical beams 123 at the left and right ends of the first fence 12 are self-limited, facilitating the fit mounting of the vertical beams 123 and the connecting plate 124. That is, when the two vertical beams 123 at the left and right ends of the first fence 12 are connected to the connecting plate 124, as long as the first flanges 1233 and the second flanges 1235 of the corresponding vertical beams 123 are respectively fitted to the connecting plate 124, the first flanges 1233 and the second flanges 1235 play a limiting role to facilitate subsequent connection, such as screw connection.

In some possible embodiments, with continued reference to FIGS. 16 and 17, each vertical beam 123 is of a hollow structure 1232, a first blocking block 1234 is received at one longitudinal end of each vertical beam 123, a second blocking block (not shown, see the structure of the first blocking block 1234) is received at the other longitudinal end of the vertical beam 123, the upper transverse beam 121 is connected to the vertical beams 123 by the first blocking blocks 1234, and the lower transverse beam 122 is connected to the vertical beams 123 by the second blocking blocks. Since each vertical beam 123 is of the hollow structure 1232, the function of weight reduction can be achieved; at the same time, one longitudinal ends of the hollow vertical beams 123 are connected to the upper transverse beam 121 by the first blocking blocks 1234, and the other longitudinal ends of the hollow vertical beams 123 are connected to the lower transverse beam 122 by the second blocking blocks, wherein a connection manner is, for example, screw connection.

Figure 18:
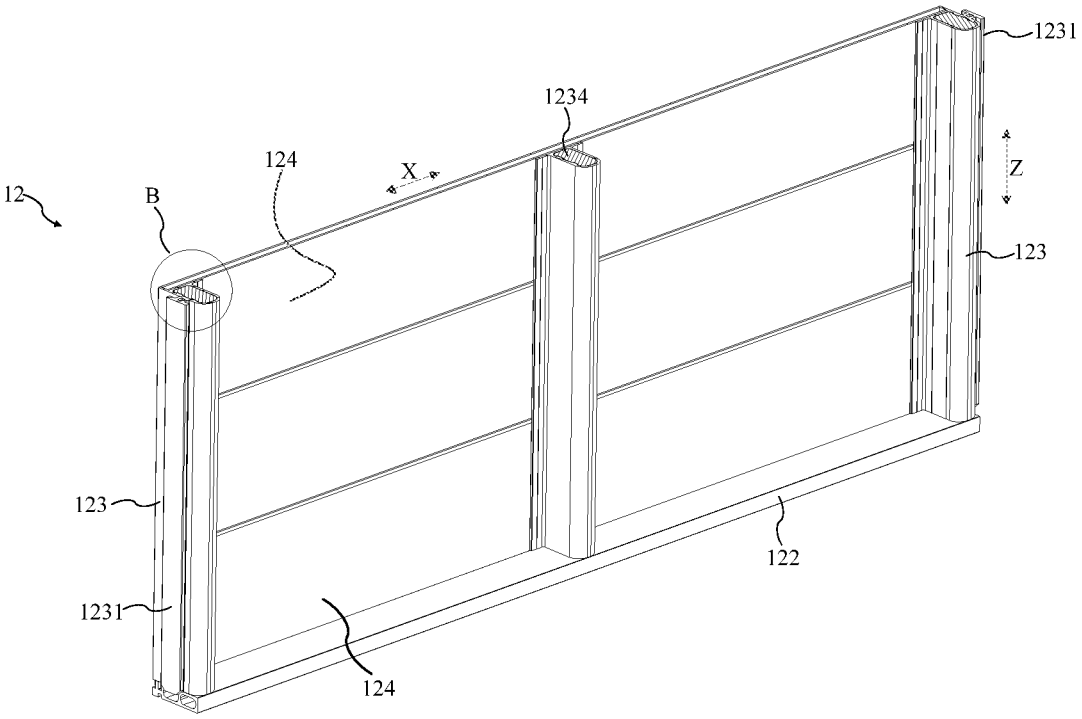
FIG. 18 illustrates a fourth perspective view of the fence in the pool body according to the embodiment of the present invention.
Figure 19:
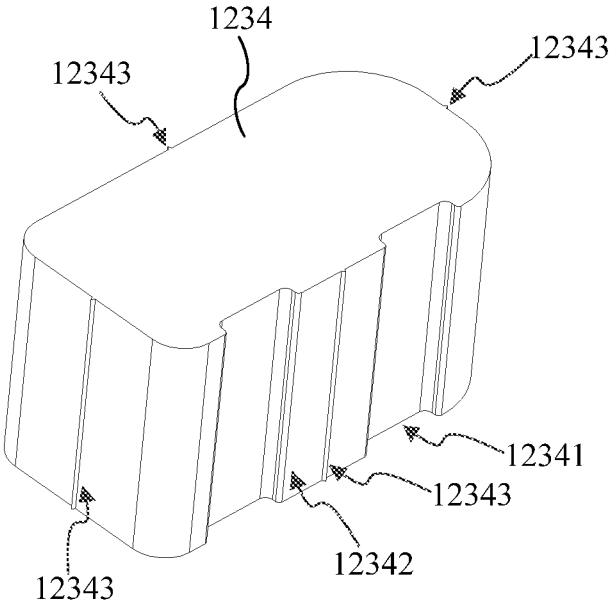
FIG. 19 illustrates a perspective view of a blocking block in the pool body according to the embodiment of the present invention.
Figure 20:
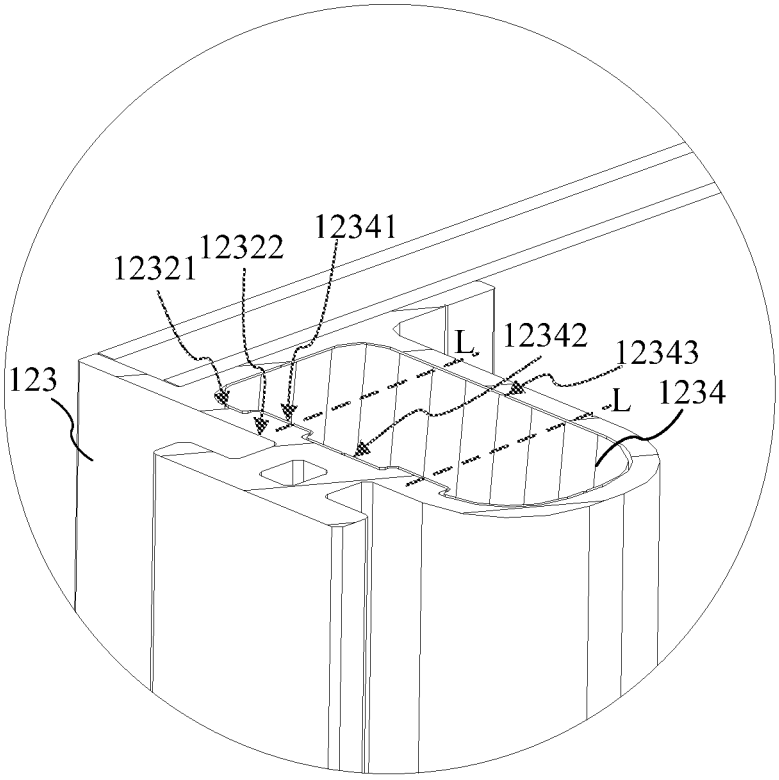
FIG. 20 shows an enlarged view of a portion B in FIG. 18.
Figure 21:
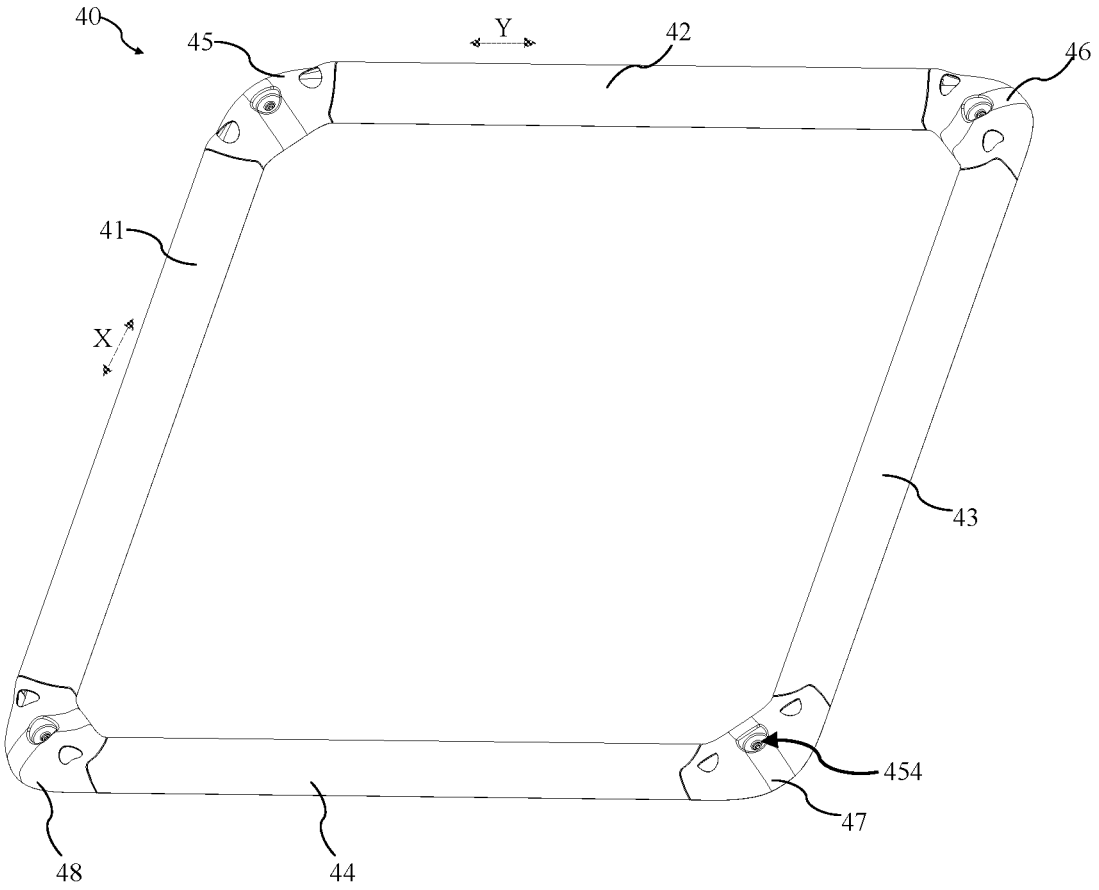
FIG. 21 illustrates a perspective view of a cover plate assembly in the pool body according to the embodiment of the present invention.

Referring to FIGS. 18 to 20, in the present application, an outer circumferential surface of each of the first blocking blocks 1234 and the second blocking blocks is provided with anti-slip structures 12343 in a protruding manner for abutting against an inner wall of the corresponding vertical beam 123 after each blocking block is placed in the corresponding vertical beam 123, and no relative movement of each blocking block and the corresponding vertical beam 123 in the longitudinal direction occurs when no external force is applied to each blocking block. Exemplarily, each first blocking block 1234 has a tetragonal shape, and an anti-slip structure 12343 is arranged on each side of the periphery of the first blocking block 1234, i.e. four anti-slip structures 12343. But the number of the anti-slip structures 12343 is not limited thereto in the present application, and in some possible embodiments, the number of the anti-slip structures 12343 is, for example, two, three, five, or the like. After the outer circumferential surface of each blocking block is provided with the anti-slip structures 12343, the blocking block cannot slide inside the corresponding vertical beam 123, the blocking blocks cannot be difficult to enter the corresponding vertical beams 123, the assembly is convenient, and the blocking blocks are effectively connected with the corresponding vertical beams 123.

Exemplarily, each anti-slip structure 12343 extends in the longitudinal direction. Exemplarily, in the longitudinal direction, a depth dimension of each anti-slip structure 12343 is the same as a depth dimension of the corresponding blocking block. In this arrangement, an abutment force between each blocking block placed in the corresponding vertical beam 123 and the inner wall of the corresponding vertical beam 123 is increased.

Exemplarily, the remaining portion of the outer circumferential surface of each blocking block except for the anti-slip structures 12343 is in clearance fit with the inner wall of the corresponding vertical beam 123, and each blocking block abuts against the inner wall of the corresponding vertical beam 123 through the anti-slip structures 12343 to limit the relative movement of each blocking block and the corresponding vertical beam 123 in the longitudinal direction. When the upper transverse beam 121 and the lower transverse beam 122 are connected to the vertical beams 123, the blocking blocks are placed at openings of the vertical beams 123, and are struck so that the blocking blocks are placed in the vertical beams 123. After the blocking blocks are completely placed in the vertical beams 123 (not protruding in the longitudinal direction), no relative movement of the blocking blocks occurs in the vertical beams 123, thereby facilitating the connection of the first blocking blocks 1234 to the upper transverse beam 121 and the connection of the second blocking blocks to the lower transverse beam 122.

Exemplarily, the structure of each first blocking block 1234 and the structure of each second blocking block are the same. Referring to FIG. 19, description is made by taking the structure of the first blocking block 1234 as an example, and each anti-slip structure 12343 on the outer circumferential surface of each first blocking block 1234 is V-shaped. That is, in the longitudinal direction, a projection of each anti-slip structure 12343 is V-shaped.

With continued reference to FIGS. 17-20, each blocking block is in concave-convex fit with an inner wall of the corresponding vertical beam 123. As shown in FIG. 17, an inner wall of one side of each vertical beam 123 is provided with inner wall concave portions 12321 and inner wall convex portions 12322, and each inner wall concave portion 12321 and the corresponding inner wall convex portion 12322 are adjacently disposed. Referring to FIG. 19, the surface, facing the inner wall of the side of the corresponding vertical beam 123, of each first blocking block 1234 is provided with blocking block convex portions 12342 that are matched with the corresponding inner wall concave portions 12321, and blocking block concave portions 12341 that are matched with the corresponding inner wall convex portions 12322. Referring to FIG. 20, after the first blocking blocks 1234 are placed in the vertical beams 123, the inner wall concave portions 12321 are in concave-convex fit with the blocking block convex portions 12342, and the inner wall convex portions 12322 are in concave-convex fit with the blocking block concave portions 12341.

The blocking blocks and the inner walls of the vertical beams 123 are not in plane-to-plane contact, but are in concave-convex fit. Each blocking block is fixedly connected to the inner wall of the corresponding vertical beam 123 at a concave-convex fit position by screws, and self-tapping screws are received in concave-convex structures between the blocking blocks and the inner walls of the vertical beams 123. That is, the inner wall concave portions 12321 and the blocking block convex portions 12342 are fixedly connected by screws after being in concave-convex fit, and the inner wall convex portions 12322 and the blocking block concave portions 12341 are fixedly connected by screws after being in concave-convex fit. Exemplarily, each dashed line L in FIG. 20 represents a screw. Compared with the "plane-to-plane contact" between the blocking blocks and the inner walls of the vertical beams 123, a concave-convex design between the blocking blocks and the inner walls of the vertical beams 123 acts as a reinforcing rib, with more areas of screw connection, and thus the connections between the blocking blocks and the vertical beams 123 are more stable.

As can be seen from the above description, the adjacent fences are detachably connected in the circumferential direction by the corresponding corner beam, and each fence is detachably connected in the longitudinal direction by the upper transverse beam 121, the lower transverse beam 122, the connecting plate 124 and the plurality of the vertical beams 123.

Referring to FIGS. 4 to 13, the upper transverse beam 121 of each fence is in concave-convex fit with the connecting portion 22 of the soft pool body 20 in the present application. In this arrangement, connection of the soft pool body 20 to the outer frame 10 is facilitated.

Figure 13:
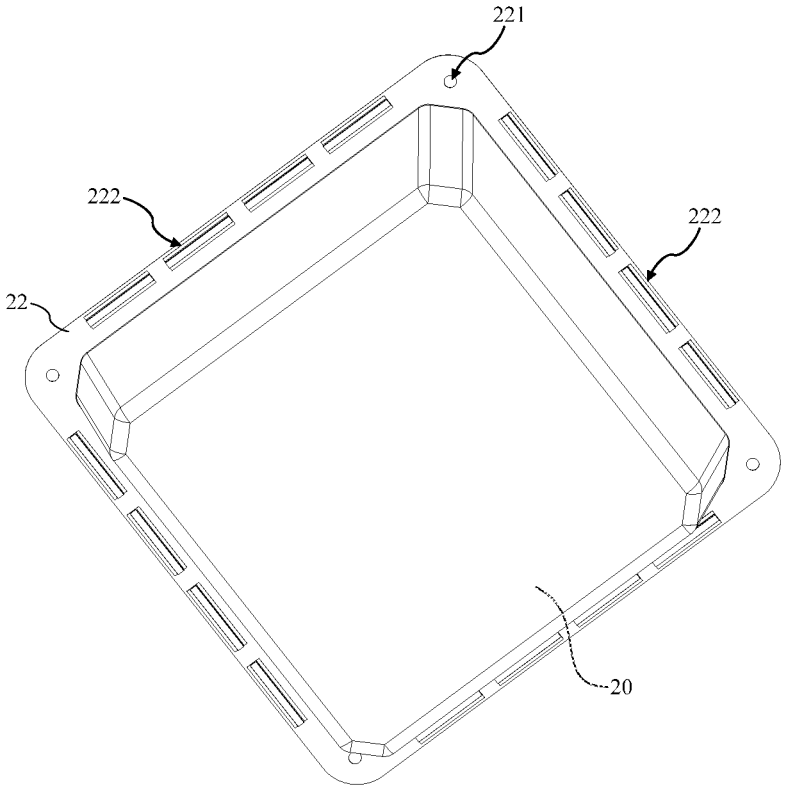
FIG. 13 illustrates a second perspective view of the soft pool body in the pool body according to the embodiment of the present invention.
Figure 14:
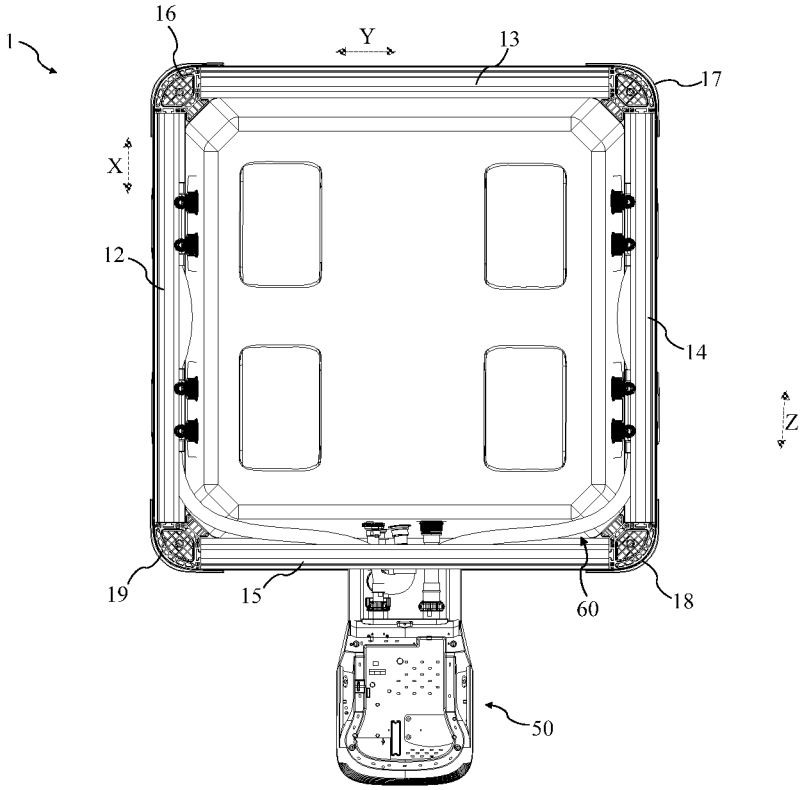
FIG. 14 illustrates a top view of the pool body according to the embodiment of the present invention.

Exemplarily, with reference to FIGS. 5 and 6, the upper transverse beam 121 of each fence is provided with a groove 1211 extending in the same direction as that of the upper transverse beam 121; and referring to FIG. 13, one side, facing the upper transverse beams 121, of the connecting portion 22 of the soft pool body 20 is provided with bumps 222, and the bumps 222 are in concave-convex fit with the grooves 1211. Four sides of the connecting portion 22 of the soft pool body 20 shown in FIG. 13 each are provided with a plurality of bumps 222, the plurality of the bumps 222 having a strip shape as a whole, and the connection portion 22 of the soft pool body 20 is clamped into the grooves 1211 of the upper transverse beams 121 through the bumps 222. Four bumps 222 are arranged on each side of the periphery of the connecting portion 22 of the soft pool body 20 shown in FIG. 13, but the number of the bumps 222 is not limited thereto. In some possible embodiments, the number of the bumps 222 on each side of the periphery of the connecting portion 22 of the soft pool body 20 may be the same or different, e.g., three, five, etc.

Exemplarily, the connecting portion 22 of the soft pool body 20 is high-frequency ironed with PVC strips to form the above-mentioned bumps 222, with high-frequency connection of rigid PVC strips and net clamping PVC. The PVC strips are clamped into the grooves 1211 of the upper transverse beams 121, the connection is stable, and the mounting is convenient.

Figure 12:
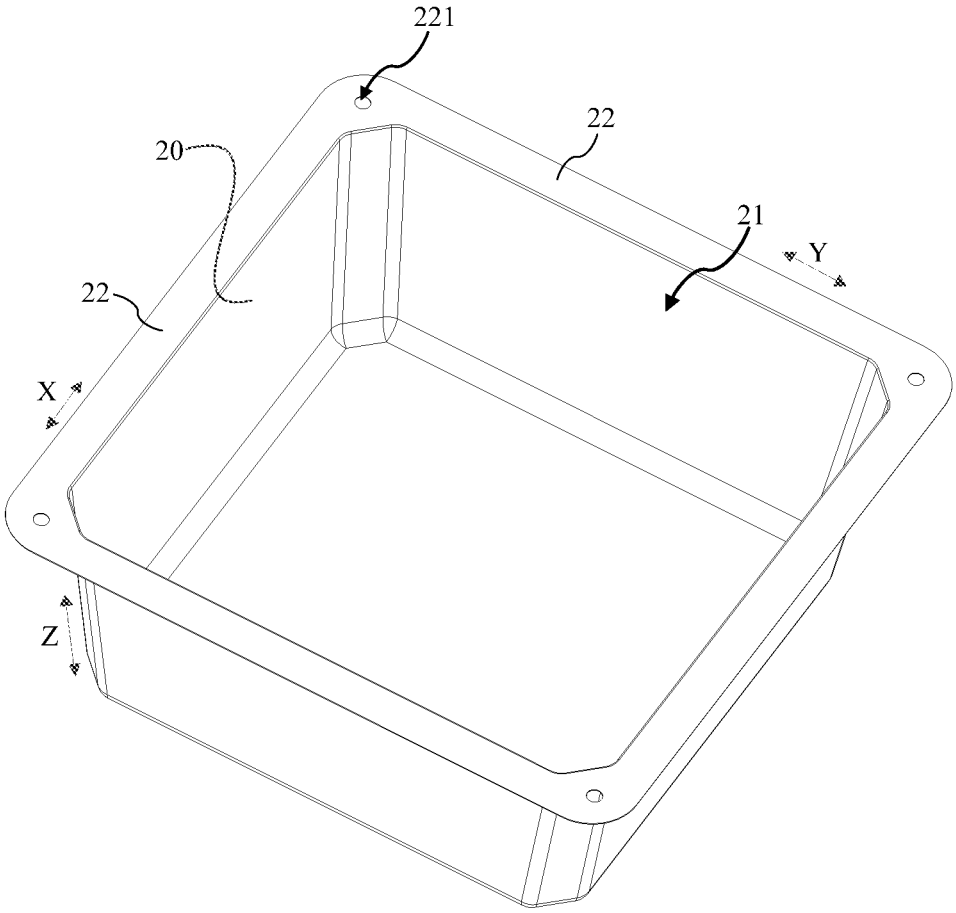
FIG. 12 illustrates a first perspective view of a soft pool body in the pool body according to the embodiment of the present invention.

Referring to FIGS. 12 and 13, four corners of the connecting portion 22 of the soft pool body 20 each are provided with a pool body connecting hole 221, and the connecting portion 22 of the soft pool body 20 sleeves the positioning posts 303 on the corresponding corner beams described later through the four pool body connecting holes 221 (refer to FIG. 4). Prepositioning of the four sides of the soft pool body 20 and the fences is realized so that the connecting portion 22 of the soft pool body 20 is clamped into the grooves 1211 of the upper transverse beams 121 through the bumps 222.

Figure 9:
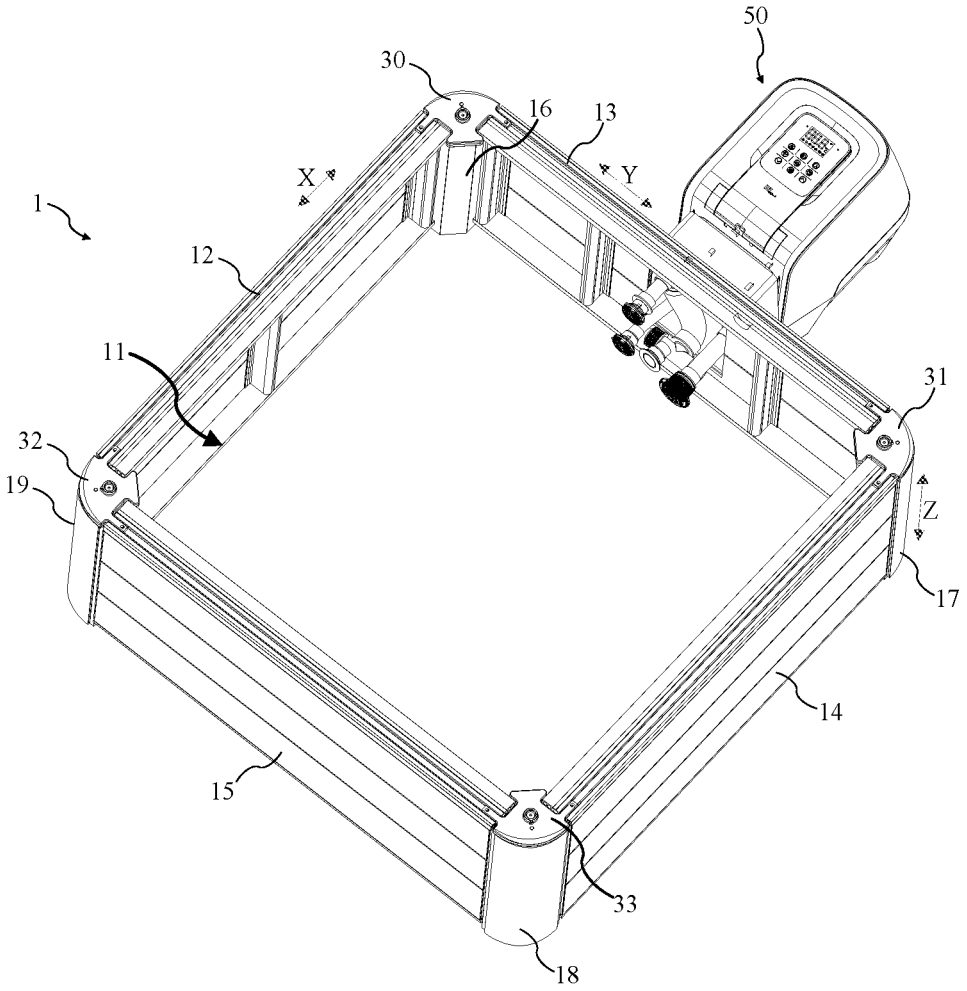
FIG. 9 illustrates a sixth perspective view of the pool body according to the embodiment of the present invention.
Figure 10:
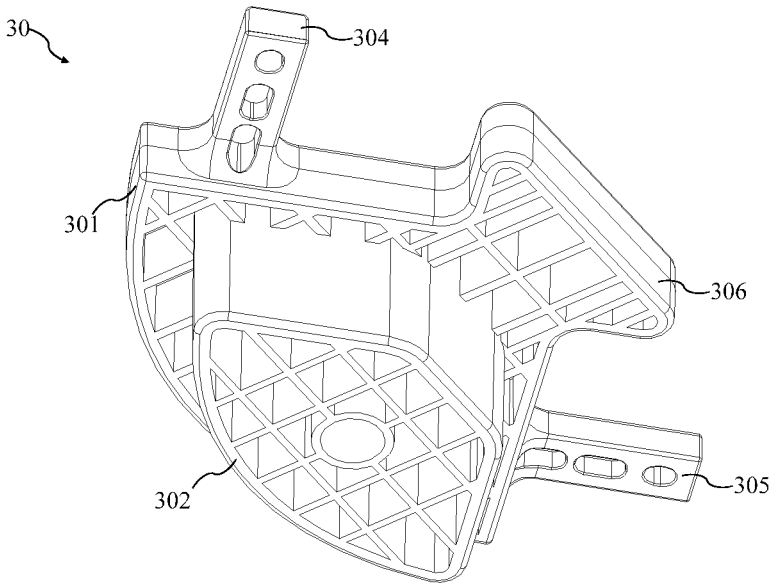
FIG. 10 illustrates a first perspective view of a positioning member in the pool body according to the embodiment of the present invention.
Figure 11:
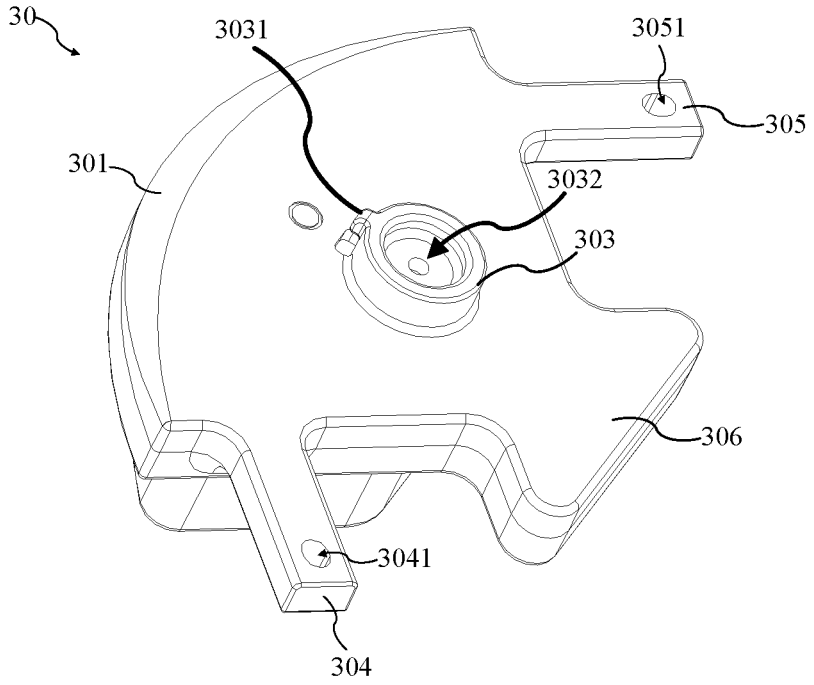
FIG. 11 illustrates a second perspective view of the positioning member in the pool body according to the embodiment of the present invention.

In some possible embodiments, with reference to FIGS. 9-11, the outer frame 10 further includes positioning members, wherein each corner beam is provided with one of the positioning members. That is, a first positioning member 30 is mounted on the first corner beam 16, a second positioning member 31 is mounted on the second corner beam 17, a third positioning member 33 is mounted on the third corner beam 18, and a fourth positioning member 32 is mounted on the fourth corner beam 19. Exemplarily, the structure of each positioning member is the same, and the present application is illustrated by taking the structure of the first positioning member 30 as an example. As shown in FIGS. 10 and 11, the first positioning member 30 includes a positioning member body 301 having a shape that is similar to the shape of the corresponding corner beam. That is, after the positioning member body 301 is mounted in the corresponding corner beam, the positioning member body 301 can cover the corresponding corner beam.

For example, the positioning member body 301 on the first positioning member 30 covers the mounted first corner beam 16. Each corner beam has a hollow structure and has a corner beam cavity 163 extending in the longitudinal direction, so that weight reduction can be realized. The first positioning member 30 includes a tubular structure 302 disposed on one side, facing the first corner beam 16, of the first positioning member 30, the tubular structure 302 is inserted into the hollow structure of the first corner beam 16 (i.e., in the corner beam cavity 163) such that the first positioning member 30 is mounted in the first corner beam 16 and covers the first corner beam 16 (as shown in FIG. 9). By a structure in which a pipe sleeves a pipe (each tubular structure 302 is inserted into the hollow structure of the corresponding corner beam), bending resistance and material reduction are achieved.

The positioning member body 301 is provided with a positioning post 303 in a protruding manner, and a portion, corresponding to the corresponding corner beam, of each pool body connecting hole 221 of the connecting portion 22 of the soft pool body 20 sleeves the corresponding positioning post 303. That is, the four pool body connecting holes 221 of the connecting portion 22 of the soft pool body 20 respectively sleeve the positioning post 303 of the first positioning member 30, the positioning post 303 of the second positioning member 31, the positioning post 303 of the third positioning member 33, and the positioning post 303 of the fourth positioning member 32, so that prepositioning of the four sides of the soft pool body 20 and the fences is realized.

As shown in FIG. 11, the outer surface of each positioning post 303 is provided with a first detachment prevention structure 3031 in a protruding manner for limiting the detachment of the connecting portion 22 from the positioning posts 303 after the pool body connecting holes 221 in the connecting portion 22 of the soft pool body 20 sleeve the positioning posts 303. In the longitudinal direction, each positioning post 303 and the first detachment prevention structure 3031 on the positioning post 303 protrude from the soft pool body 20, so that prepositioning of four sides of the soft pool body 20 and the fences is stable. Exemplarily, the whole structure of each positioning post 303 is a cylindrical boss with an ear (the first detachment prevention structure 3031) for hanging the soft pool body 20 and having the detachment prevention function.

With continued reference to FIGS. 10 and 11, each positioning member body 301 further includes a first extension 304 extending toward and fixedly connected to one of grooves 1211 of adjacent upper transverse beams 121, and a second extension 305 extending toward and fixedly connected to the other groove of the grooves 1211 of the adjacent upper transverse beams 121. Exemplarily, each first extension 304 and the corresponding second extension 305 are perpendicular to each other. Exemplarily, the first extensions 304 and the second extensions 305 on the positioning member bodies 301 are flush with the longitudinal top ends of the fences.

For example, the first extension 304 of the first positioning member 30 is located in one end of the groove 1211 of the first fence 12 and fixedly connected, and the second extension 305 of the first positioning member 30 is located in one end of the groove 1211 of the second fence 13 and fixedly connected. The first extension 304 of the second positioning member 31 is located in the other end of the groove 1211 of the second fence 13 and fixedly connected, and the second extension 305 of the second positioning member 31 is located in one end of the groove 1211 of the third fence 14 and fixedly connected; the first extension 304 of the third positioning member 33 is located in the other end of the groove 1211 of the third fence 14 and fixedly connected, and the second extension 305 of the third positioning member 33 is located in one end of the groove 1211 of the fourth fence 15 and fixedly connected; and the first extension 304 of the fourth positioning member 32 is located in the other end of the groove 1211 of the fourth fence 15 and fixedly connected, and the second extension 305 of the fourth positioning member 32 is located in the other end of the groove 1211 of the first fence and fixedly connected.

Thus, the first fence 12, the first positioning member 30, the first corner beam 16, the second fence 13, the second positioning member 31, the second corner beam 17, the third fence 14, the third positioning member 33, the third corner beam 18, the fourth fence 15, the fourth positioning member 32, and the fourth corner beam 19 are connected, the structural elements are integrally connected so that the connection of the outer frame 10 is more compact and reliable to withstand the tension at the corners after the liner is filled with water.

Exemplarily, a manner of the fixed connection is, for example, screw connection. Each first extension 304 is provided with a first screw hole 3041, and each first screw hole 3041 is fixedly connected with the groove 1211 of the corresponding fence by a screw; and each second extension 305 is provided with a second screw hole 3051, and each second screw hole 3051 is fixedly connected with the groove 1211 of the corresponding fence by a screw.

With continued reference to FIGS. 9-11, in some possible embodiments, each positioning member body 301 further includes a third extension 306 that is clamped between the adjacent fences. That is, each third extension 306 is positioned between the corresponding first extension 304 and the corresponding second extension 305, and after the first extensions 304 and the second extensions 305 are respectively received in the grooves 1211 of the adjacent upper transverse beams 121, the third extensions 306 are positioned in the hard pool body receiving cavity 11 and positioned between the adjacent fences. That is, the third extension 306 of the first positioning member 30 is clamped between the first fence 12 and the second fence 13, the third extension 306 of the second positioning member 31 is clamped between the second fence 13 and the third fence 14, the third extension 306 of the third positioning member 33 is clamped between the third fence 14 and the fourth fence 15, and the third extension 306 of the fourth positioning member 32 is clamped between the fourth fence 15 and the first fence. In this arrangement, the adjacent fences are limited and fixed by the corresponding third extensions 306, so that the overall connection of the outer frame 10 is more compact and reliable to withstand the tension at the corners after the liner is filled with water.

With continued reference to FIGS. 9-11, in some possible embodiments, the positioning post 303 on each positioning member body 301 is provided with a positioning connecting hole 3032 for being fixedly connected with a corresponding cover plate connecting hole 454 (see FIGS. 22 and 23) in a cover plate assembly 45 described later. The cover plate assembly 45 plays a decorative role for covering the connecting portion 22 of the soft pool body 20. Exemplarily, the positioning connecting holes 3032 in the positioning posts 303 and the cover plate connecting holes 454 are fixedly connected by screws. Edge decoration of the outer frame 10 of the detachable bathtub is realized, i.e., the upper transverse beams 121 of the fences are decorated. Also, the cover plate assembly 45 is detachable and can be stored.

That is, the four sides of the connecting portion 22 of the soft pool body 20 and the fences are prepositioned, and the connecting portion 22 of the soft pool body 20 is clamped into the grooves 1211 of the upper transverse beams 121 through the bumps 222, the cover plate assembly 45 is connected to the positioning connecting holes 3032 of the positioning posts 303 of the positioning member bodies 301, and the cover plate assembly 45 covers the connecting portion 22 of the soft pool body 20, playing a decorative role.

Exemplarily, the overall visual effect after the cover plate assembly 45 is mounted on the outer frame 10 is close to the integrated acrylic effect, with no redundant features visible.

Since the cover plate assembly 45 is connected to the positioning connecting holes 3032 of the positioning member bodies 301 mounted on the corresponding corner beams, and since the first extension 304 and the second extension 305 of each positioning member body 301 are fixedly connected to the grooves 1211 of the adjacent upper transverse beams 121, respectively, the cover plate assembly 45 and the corner beams are prevented from being pulled out as a whole. Because the fences play a longitudinal limiting role on the positioning member bodies 301 through the first extensions and the second extensions 305, thereby exerting a longitudinal limiting role on the cover plate assembly 45 and the corresponding corner beams.

In some possible embodiments, with reference to FIGS. 21 to 25, the cover plate assembly 45 of the present application includes: a first cover plate 41, a second cover plate 42, a third cover plate 43 and a fourth cover plate 44 which are sequentially distributed along the circumferential direction. As described above, the plurality of the fences enclose the hard pool body receiving cavity 11 of a quadrilateral shape, and accordingly, the cover plate assembly 45 of the present application has a quadrilateral shape as a whole.

As shown in connection with FIGS. 1 and 4, the first cover plate 41 and the third cover plate 43 extend along the first direction (shown in an X direction in FIG. 21), respectively, the second cover plate 42 and the fourth cover plate 44 extend along the second direction (shown in a Y direction in FIG. 21), respectively, the first cover plate 41 covers the upper transverse beam 121 of the first fence 12 to cover the connecting portion 22 of the soft pool body 20 clamped to the upper transverse beam 121 of the first fence 12; the second cover plate 42 covers the upper transverse beam 121 of the second fence 13 to cover the connecting portion 22 of the soft pool body 20 clamped to the upper transverse beam 121 of the second fence 13; the third cover plate 43 covers the upper transverse beam 121 of the third fence 14 to cover the connecting portion 22 of the soft pool body 20 clamped to the upper transverse beam 121 of the third fence 14; and the fourth cover plate 44 covers the upper transverse beam 121 of the fourth fence 15 to cover the connecting portion 22 of the soft pool body 20 clamped to the upper transverse beam 121 of the fourth fence 15.

Figure 25:
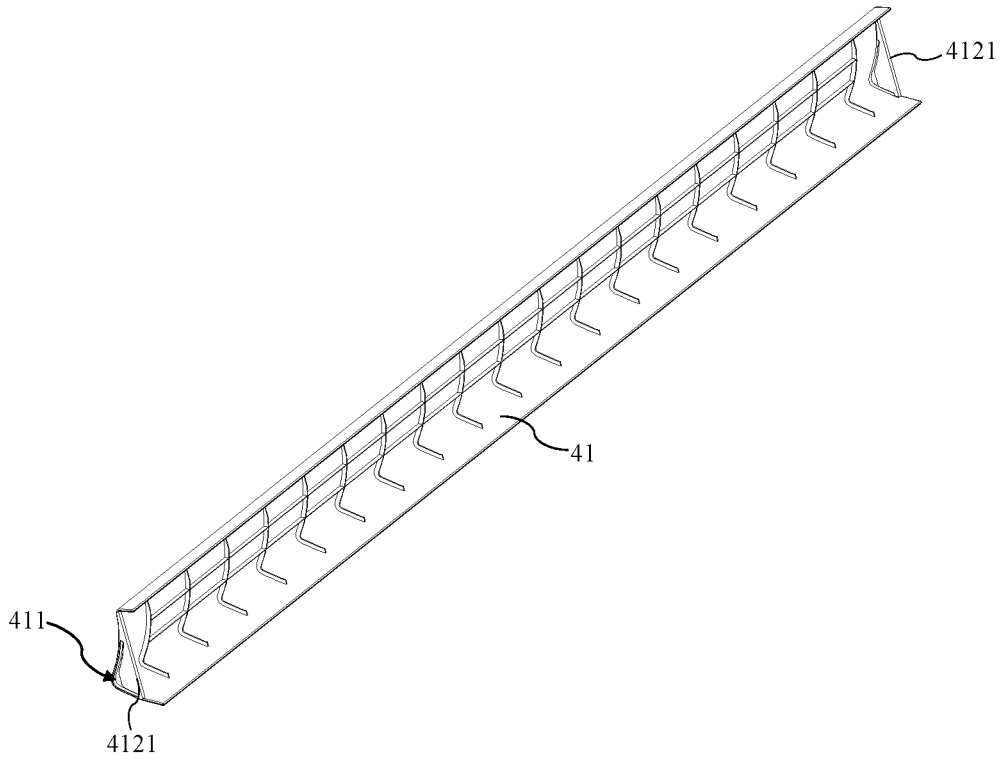
FIG. 25 illustrates a second perspective view of the cover plate in the cover plate assembly in the pool body according to the embodiment of the present invention.

In some possible embodiments, each cover plate includes a transition structure 412, description is made by taking the first cover plate 41 as an example, referring to FIG. 25, the transition structure 412 of the first cover plate 41 is roughly a frame shaped structure with an opening at one end, including top surfaces 4121 located at both ends of the extension direction of the first cover plate 41, and two side surfaces 4121 and 4122 respectively perpendicularly connected to the top surfaces 4121 of the transition structure 412. The shape of the transition structure 412 is similar to the shape of the upper transverse beam 121 of the first fence 12. When the first cover plate 41 covers the upper transverse beam 121 of the first fence 12, the top surfaces 4121 of the transition structure 412 of the first cover plate 41 are fitted to a top surface of the upper transverse beam 121 of the first fence 12 without misalignment, and the two side surfaces 4121 and 4122 of the transition structure 412 of the first cover plate 41 are fitted to two side surfaces of the upper transverse beam 121 of the first fence 12 without misalignment, respectively. This is equivalent to that the first cover plate 41 clamps the upper transverse beam 121 of the first fence 12 through the transition structure 412. Accordingly, the second cover plate 42 clamps the upper transverse beam 121 of the second fence 13 through the transition structure 412. The third cover plate 43 clamps the upper transverse beam 121 of the third fence 14 through the transition structure 412. The fourth cover plate 44 clamps the upper transverse beam 121 of the fourth fence 15 through the transition structure 412.

In addition, one transition structure is designed for each cover plate, and a frame shaped cross section of the transition structure 412 can resist bending, improving the strength of the first cover plate 41. In addition, a plurality of reinforcing ribs are arranged on one side, facing the corresponding fence, of each cover plate, and each reinforcing rib is bent.

In addition, in the first direction, one end of the first cover plate 41 and one end of the second cover plate 42 are detachably connected through a first transition piece 45, the other end of the first cover plate 41 and one end of the fourth cover plate 44 are detachably connected through a second transition piece 48; and in the first direction, one end of the third cover plate 43 and the other end of the second cover plate 42 are detachably connected by a third transition piece 46, and the other end of the third cover plate 43 and the other end of the fourth cover plate 44 are detachably connected by a fourth transition piece 47. That is, the first cover plate 41, the first transition piece 45, the second cover plate 42, the third transition piece 46, the third cover plate 43, the fourth transition piece 47, the fourth cover plate 44 and the second transition piece 48 are detachably connected in the circumferential direction. Edge decoration of the detachable bathtub is achieved, and is detachable.

As shown in FIG. 4, the positioning posts 303 protrude from the soft pool body 20. And referring to FIGS. 11 and 22, the first transition piece 45 described above covers the positioning member on the first corner beam 16 and is fixedly connected with the connecting hole in the positioning post 303 on the first corner beam 16; the second transition piece 48 covers the positioning member on the second corner beam 17 and is fixedly connected with the connecting hole in the positioning post 303 on the second corner beam 17; the third transition piece 46 covers the positioning member on the third corner beam 18 and is fixedly connected with the connecting hole in the positioning post 303 on the third corner beam 18; and the fourth transition piece 47 covers the positioning member on the fourth corner beam 19 and is fixedly connected with the connecting hole in the positioning post 303 on the fourth corner beam 19.

Thus, the first transition piece 45 covers a portion, corresponding to the first corner beam 16, of the connecting portion 22 of the soft pool body 20 (i.e., a corner of the connecting portion 22), the second transition piece 48 covers a portion, corresponding to the second corner beam 17, of the connecting portion 22 (i.e., a corner of the connecting portion 22), the third transition piece 46 covers a portion, corresponding to the third corner beam 18, of the connecting portion 22 (i.e., a corner of the connecting portion 22), and the fourth transition piece 47 covers a portion, corresponding to the fourth corner beam 19, of the connecting portion 22 (i.e., a corner of the connecting portion 22). Then, the cover plate assembly 45 enclosed by the first cover plate 41, the first transition piece 45, the second cover plate 42, the third transition piece 46, the third cover plate 43, the fourth transition piece 47, the fourth cover plate 44, and the second transition piece 48 which are detachably connected in the circumferential direction covers the connecting portion 22 of the soft pool body 20.

Since the first cover plate 41, the first transition piece 45, the second cover plate 42, the third transition piece 46, the third cover plate 43, the fourth transition piece 47, the fourth cover plate 44 and the second transition piece 48 are detachably connected in the circumferential direction, the overall mounting is convenient, and after the first transition piece 45, the second transition piece 48, the third transition piece 46 and the fourth transition piece 47 are fixedly connected to the corresponding corner beams, the cover plate assembly 45 is connected to the outer frame 10, the circumferential limit is achieved, the first cover plate 41, the second cover plate 42, the third cover plate 43 and the fourth cover plate 44 are not separated from the corresponding transition pieces, and the connection reliability is improved.

A specific detachable connection mode between each cover plate and the corresponding transition piece is not limited in this application. Exemplarily, each cover plate is connected with the corresponding transition piece in an insertion manner. Namely, one end of the first cover plate 41 and one end of the second cover plate 42 are respectively connected with the first transition piece 45 in an insertion manner, the other end of the first cover plate 41 and one end of the fourth cover plate 44 are respectively connected with the second transition piece 48 in an insertion manner; and in the first direction, one end of the third cover plate 43 and the other end of the second cover plate 42 are respectively connected with the third transition piece 46 in an insertion manner, and the other end of the third cover plate 43 and the other end of the fourth cover plate 44 are respectively connected with the fourth transition piece 47 in an insertion manner.

Exemplarily, the structure of each cover plate is the same, i.e., the structure of the first cover plate 41, the structure of the second cover plate 42, the structure of the third cover plate 43 and the structure of the fourth cover plate 44 are the same. The present application is illustrated by taking the structure of the first cover plate 41 and the structure of the first transition piece 45 as an example, referring to FIGS. 24 and 25, both ends of the extension direction (shown in an X direction in FIG. 24) of the first cover plate 41 each are provided with an insertion hole 411, and the first transition piece 45 is provided with a first insertion portion 452 inserted into one of the insertion holes 411 of the adjacent cover plates, and a second insertion portion 451 inserted into the other insertion hole 411 of the insertion holes 411 of the adjacent cover plates. For example, one end of the first cover plate 41 and one end of the second cover plate 42 are respectively connected with the first transition piece 45 in an insertion manner, and correspondingly, the first insertion portion 452 of the first transition piece 45 is inserted into the insertion hole 411 at one end of the extension direction of the first cover plate 41, and the second insertion portion 451 of the first transition piece 45 is inserted into the insertion hole 411 at one end of the extension direction of the second cover plate 42.

Accordingly, the first insertion portion 452 of the second transition piece 48 is inserted into the insertion hole 411 at the other end of the extension direction of the first cover plate 41, and the second insertion portion 451 of the second transition piece 48 is inserted into the insertion hole 411 at one end of the extension direction of the fourth cover plate 44. The first insertion portion 452 of the third transition piece 46 is inserted into the insertion hole 411 at the other end of the extension direction of the second cover plate 42, and the second insertion portion 451 of the third transition piece 46 is inserted into the insertion hole 411 at one end of the extension direction of the third cover plate 43. The first insertion portion 452 of the fourth transition piece 47 is inserted into the insertion hole 411 at the other end of the extension direction of the fourth cover plate 44, and the second insertion portion 451 of the fourth transition piece 47 is inserted into the insertion hole 411 at one end of the extension direction of the third cover plate 43.

Figure 22:
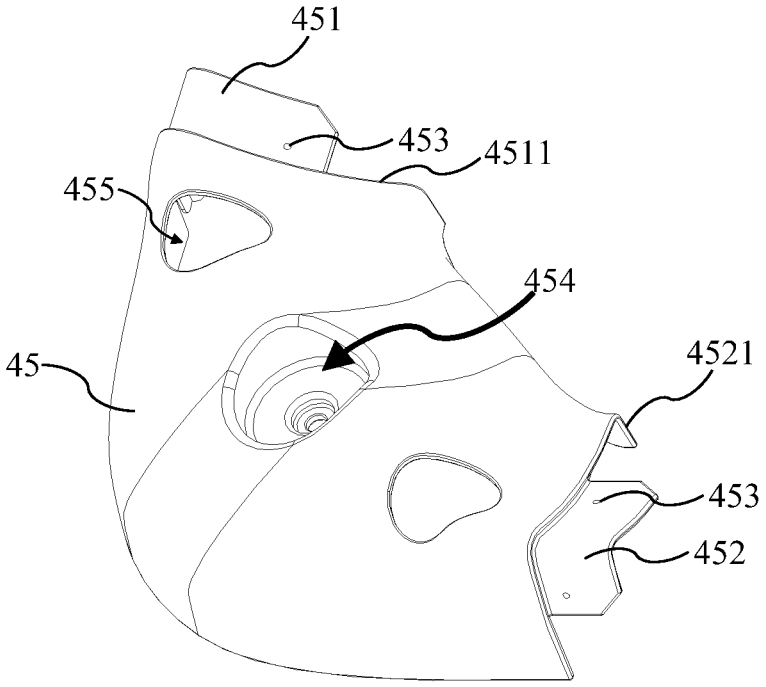
FIG. 22 illustrates a first perspective view of a transition piece in the cover plate assembly in the pool body according to the embodiment of the present invention.

Referring to FIG. 22, in some possible embodiments, the shape of a first end 4521 and the shape of a second end 4511 of the first transition piece 45 are similar to the shapes of the ends of the corresponding cover plates (the first cover plate 41 and the second cover plate 42). After one end of the first cover plate 41 and one end of the second cover plate 42 are respectively connected with the first transition piece 45 in an insertion manner, the first end 4521 and the second end 4511 of the first transition piece 45 are respectively aligned with and fitted to one end of the first cover plate 41 and one end of the second cover plate 42. the overall decorative effect is equivalent to acrylic integrated forming.

Figure 23:
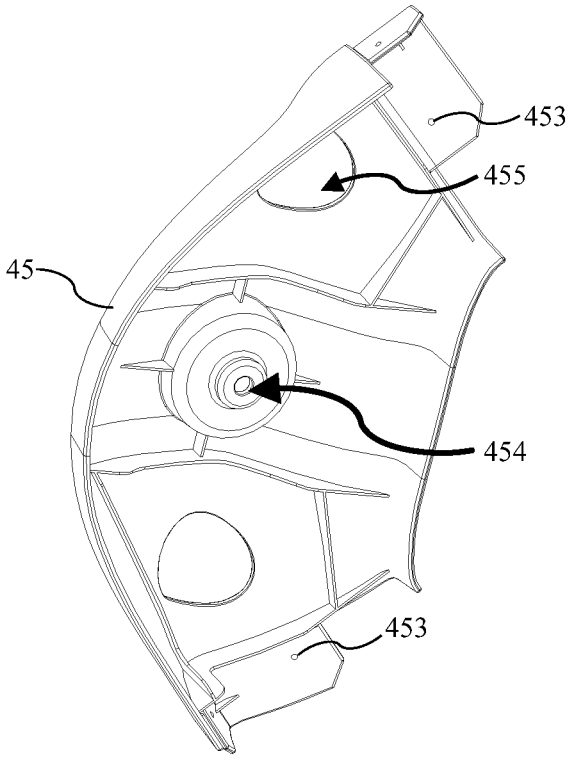
FIG. 23 illustrates a second perspective view of the transition piece in the cover plate assembly in the pool body according to the embodiment of the present invention.
Figure 24:
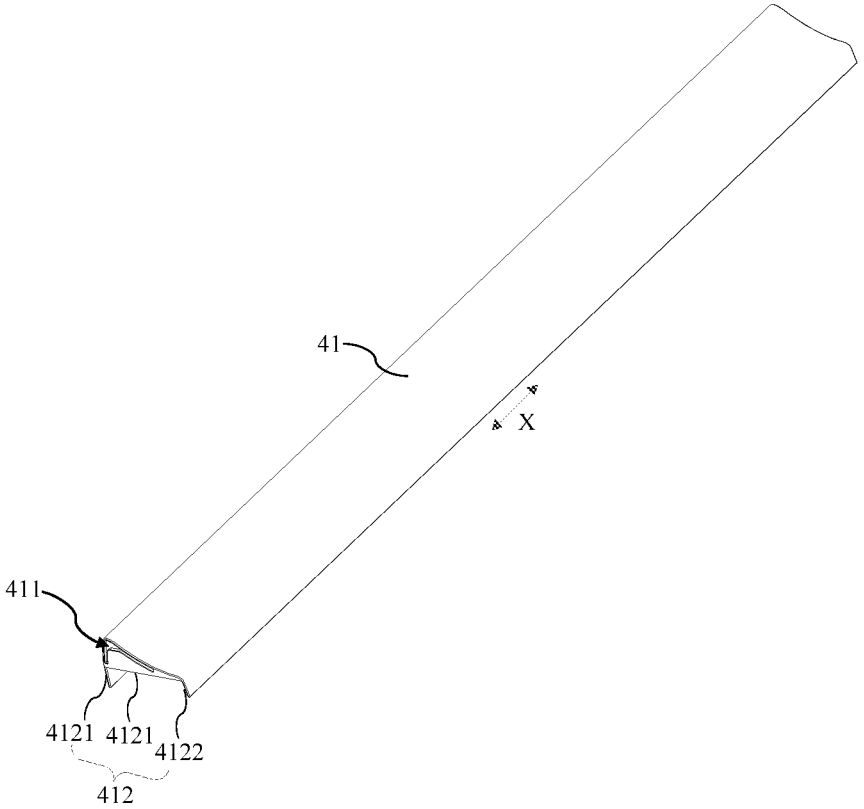
FIG. 24 illustrates a first perspective view of a cover plate in the cover plate assembly in the pool body according to the embodiment of the present invention.

With continued reference to FIGS. 22 and 23, in some possible embodiments, the surface of each first insertion portion 452 and the surface of each second insertion portion 451 each are provided with a second detachment prevention portion 453 for abutting against an inner wall of the corresponding insertion hole 411 after each insertion portion is inserted into the corresponding insertion hole 411, and no relative movement of each insertion portion and the corresponding insertion hole 411 in an insertion direction occurs when no external force is applied to each second detachment prevention portion 453. Exemplarily, two opposite sides of the surface of each first insertion portion 452 and the surface of each second insertion portion 451 each are provided with a second detachment prevention portion 453 that is clamped into the inner wall of the corresponding insertion hole 411 so that the first insertion portions 451 and the second insertion portions 451 are reliably connected to the corresponding insertion holes 411. For example, the first insertion portion 452 of the first transition piece 45 is inserted into the insertion hole 411 at one end of the extension direction of the first cover plate 41, the second detachment prevention portion 453 on the first insertion portion 452 abuts against the inner wall of the insertion hole 411 at one end of the first cover plate 41, the second insertion portion 451 of the first transition piece 45 is inserted into the insertion hole 411 at one end of the extension direction of the second cover plate 42, and the second detachment prevention portion 453 on the second insertion portion 451 abuts against the inner wall of the insertion hole 411 at one end of the second cover plate 42.

Exemplarily, each second detachment prevention portion 453 is a convex point.

In some possible embodiments, with reference to FIGS. 22 to 25, the insertion hole 411 of each cover plate is curved, and the insertion portion corresponding to each insertion hole 411 has a shape that is adapted to the shape of the corresponding insertion hole 411. That is, the shapes of the first insertion portions 452 and the second insertion portions 451 corresponding to the insertion holes 411 are also curved. In this arrangement, detachment of the transition pieces and the corresponding insertion holes 411 are prevented.

With continued reference to FIG. 22, in some possible embodiments, at least one of the transition pieces is provided with a headrest mounting hole 455 for mounting a corner headrest 70 (as shown in FIG. 1). In the present application, each of the four transition pieces is provided with the headrest mounting hole 455, and accordingly, the corner headrest 70 is mounted on each transition piece. After being mounted on the corresponding transition piece, each corner headrest 70 covers the corresponding transition piece so as to obscure redundant features. As shown in FIG. 1, the four corner headrests 70 completely cover the first transition piece 45, the second transition piece 48, the third transition piece 46, and the fourth transition piece 47.

In some possible embodiments, with reference to FIGS. 1-3, 14, and 26-33, the bathtub of the present application further includes a pipeline assembly 60, and exemplarily, the pipeline assembly 60 is used for water inlet and drainage. That is, the bathtub of the present application achieves the functions of supplying water (water inlet) to the water receiving cavity 21 of the soft pool body 20 and discharging water (water discharge) from the water receiving cavity 21 of the soft pool body 20 through the pipeline assembly 60, and at least a portion of the pipeline assembly 60 is received between the soft pool body 20 and the hard pool body receiving cavity 11. That is, at least a portion of the pipeline assembly 60 is located between the fences of the outer frame 10 and the soft pool body 20.

In this way, a pipeline layout between the fences and the soft pool body 20 is achieved such that after the soft pool body 20 is filled with water by the pipeline assembly 60, the pipeline assembly 60 does not push against the fences, causing the fences to bulge. The pipeline assembly 60 is also convenient to assemble and after-sales maintenance is convenient.

Exemplarily, the pipeline assembly 60 includes hard pipelines and soft pipelines, wherein the hard pipelines are connected to the soft pipelines. That is, the pipeline assembly 60 of the present application is formed by connecting the hard pipelines with the soft pipelines.

Figure 27:
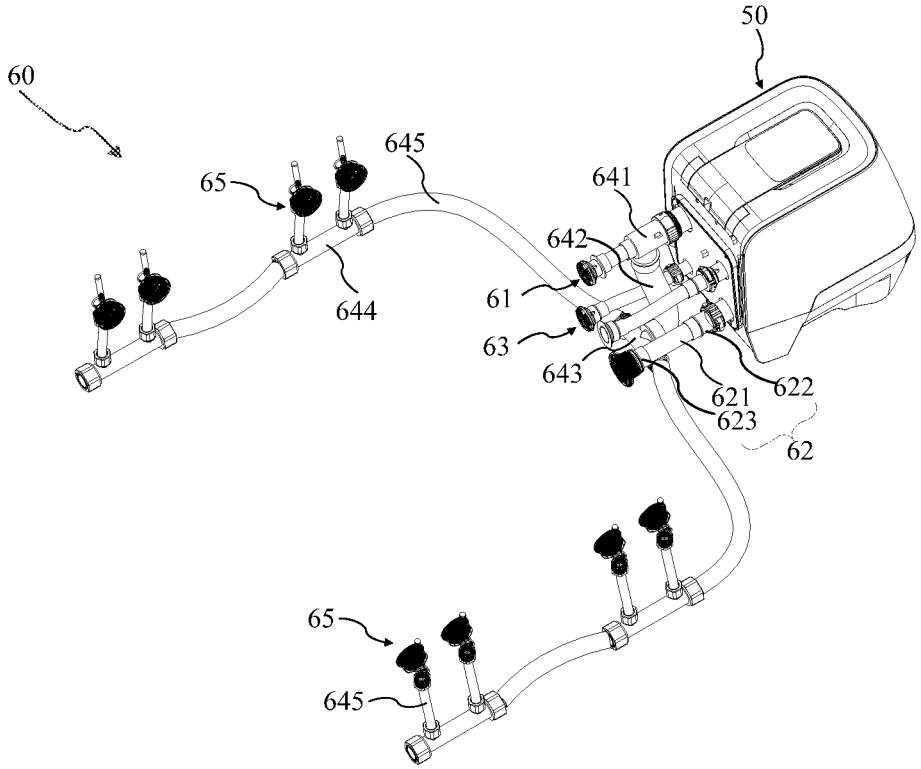
FIG. 27 illustrates a first perspective view of a pipeline assembly in the pool body according to the embodiment of the present invention.

Referring to FIG. 27, the pipeline assembly 60 of the present application includes a water inlet pipeline (a heating water inlet pipeline 61, and a nozzle water inlet pipeline shown in FIG. 27) and a water outlet pipeline (a heating water outlet pipeline 63, and a nozzle water outlet pipeline 62). Exemplarily, the heating water inlet pipeline 61 and the nozzle water inlet pipeline belong to a structure in which a pipe sleeves a pipe. One end of the water inlet pipeline of the present application is connected to the soft pool body 20, and the other end of the water inlet pipeline of the present application is connected to a control box 50. For example, one end of the heating water inlet pipeline 61 is connected to the soft pool body 20, and the other end the heating water inlet pipeline 61 is connected to the control box 50. One end of the water outlet pipeline is connected to the soft pool body 20, and the other end of the water outlet pipeline is connected to the control box 50. For example, one end of the heating water outlet pipeline 63 is connected to the soft pool body 20, and the other end of the heating water outlet pipeline 63 is connected to the control box 50. One end of the nozzle water outlet pipeline 62 is connected to the soft pool body 20, and the other end of the nozzle water outlet pipeline 62 is connected to the control box 50. Exemplarily, one end of the water inlet pipeline is connected to the soft pool body 20 by high-frequency ironing, and one end of the water outlet pipeline is connected to the soft pool body 20 by high-frequency ironing.

Exemplarily, referring to FIG. 9, the second fence 13 is provided with openings, one end of the water inlet pipeline passes through the opening in the second fence 13 and is connected to the soft pool body 20, and one end of the water outlet pipeline passes through the opening in the second fence 13 and is connected to the soft pool body 20.

In some possible embodiments, the water inlet pipeline of the present application includes a soft water inlet pipeline, and a first hard water inlet pipeline and a second hard water inlet pipeline which are located at both ends of the soft water inlet pipeline, the first hard water inlet pipeline is connected with the soft pool body 20, and the second hard water inlet pipeline is connected with the control box 50. For example, the nozzle water inlet pipeline includes a soft water inlet pipeline 642, and a first hard water inlet pipeline 643 and a second hard water inlet pipeline 641 which are located at both ends of the soft water inlet pipeline 642. Between the second hard water inlet pipeline 641 of the nozzle water inlet pipeline and the heating water inlet pipeline 61 is a soft water inlet pipeline, and a portion where the heating water inlet pipeline 61 is connected to the soft pool body 20 by high-frequency ironing, and a portion where the soft water inlet pipeline is connected to the soft pool body 20 by high-frequency ironing are hard pipelines, i.e., between a hard pipeline of the heating water inlet pipeline 61 and the second hard water inlet pipeline 641 of the nozzle water inlet pipeline is a soft water inlet pipeline.

In some possible embodiments, the water outlet pipeline includes a soft water outlet pipeline, and a first hard water outlet pipeline and a second hard water outlet pipeline which are located at both ends of the soft water outlet pipeline, the first hard water outlet pipeline is connected with the soft pool body 20, and the second hard water outlet pipeline is connected with the control box 50. For example, the nozzle water outlet pipeline 62 includes a soft water outlet pipeline 621, and a first hard water outlet pipeline 623 and a second hard water outlet pipeline 622 which are located at both ends of the soft water outlet pipeline 621. For example, the heating water outlet pipeline 63 includes a soft water outlet pipeline, and a first hard water outlet pipeline and a second hard water outlet pipeline which are located at both ends of the soft water outlet pipeline.

Since the pipeline assembly 60 between the control box 50 and the soft pool body 20 of the bathtub of the present application is formed by connecting hard pipes with hoses, compared with the connection of the soft pool body 20 and the control box 50 of the bathtub through hard pipes, water circulates with each other, the water pressure in different water depths is different after a single-layer soft pool body 20 is filled with water, and the degree of depression of the single-layer soft pool body 20 is different, which can ensure that the pipeline assembly 60 does not protrude on the soft pool body 20, but the degree of protrusion is automatically adjusted with the change of the water depth.

The connection of each hose to hard pipes at both ends may adopt a waterproof structure described later, as detailed in the following description.

In addition, the soft water inlet pipeline or the soft water outlet pipeline is provided with a hard support structure. Exemplarily, a hard support structure (e.g., a hard pipe) is disposed in the soft water outlet pipeline 621 of the nozzle water outlet pipeline 62. A hard support structure is disposed in the soft water outlet pipeline 621 to overcome a negative pressure generated during operation. It is ensured that the nozzle water outlet pipeline 62 can discharge water normally.

Figure 26:
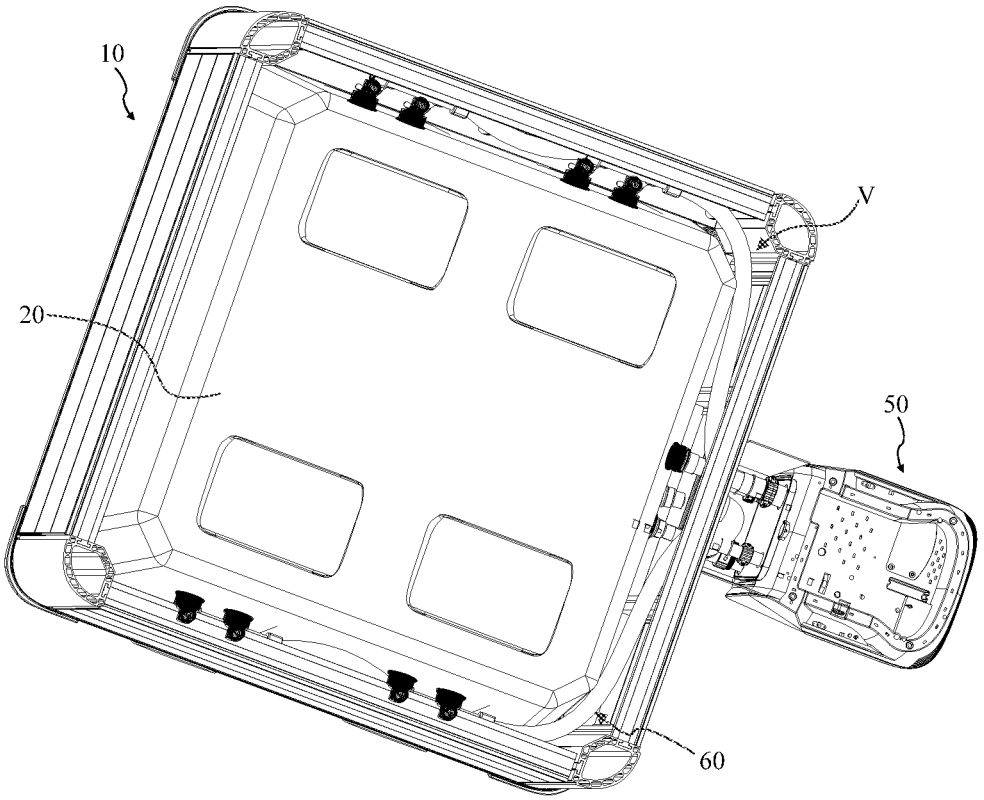
FIG. 26 illustrates a seventh perspective view of the pool body according to the embodiment of the present invention.
Figure 28:
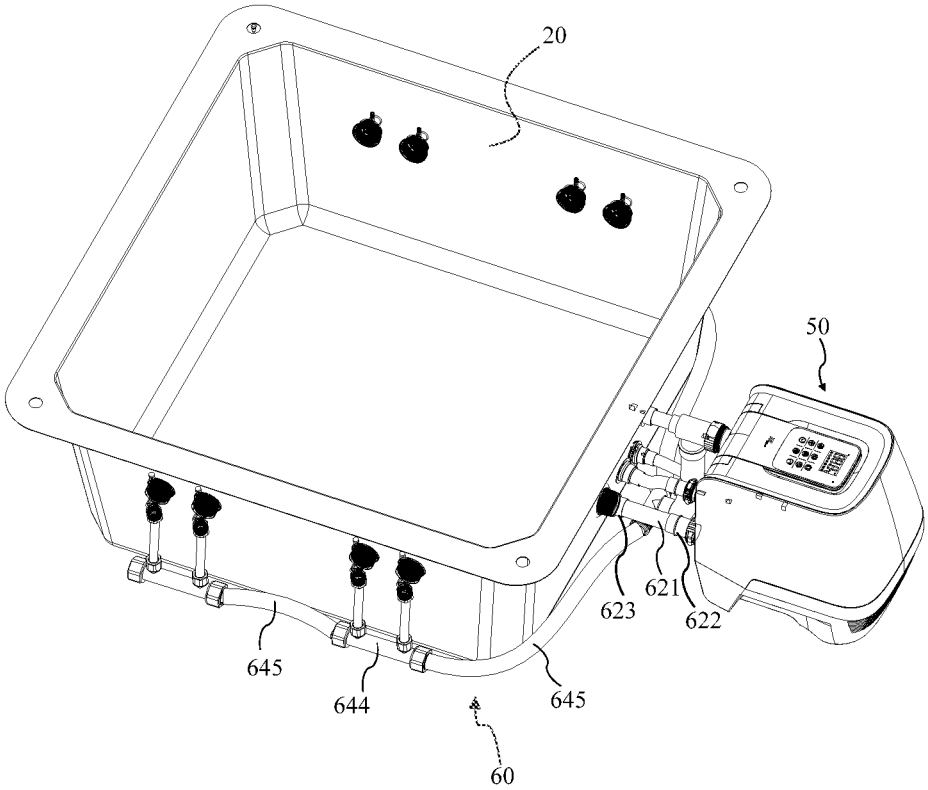
FIG. 28 illustrates a second perspective view of the pipeline assembly in the pool body according to the embodiment of the present invention.
Figure 29:
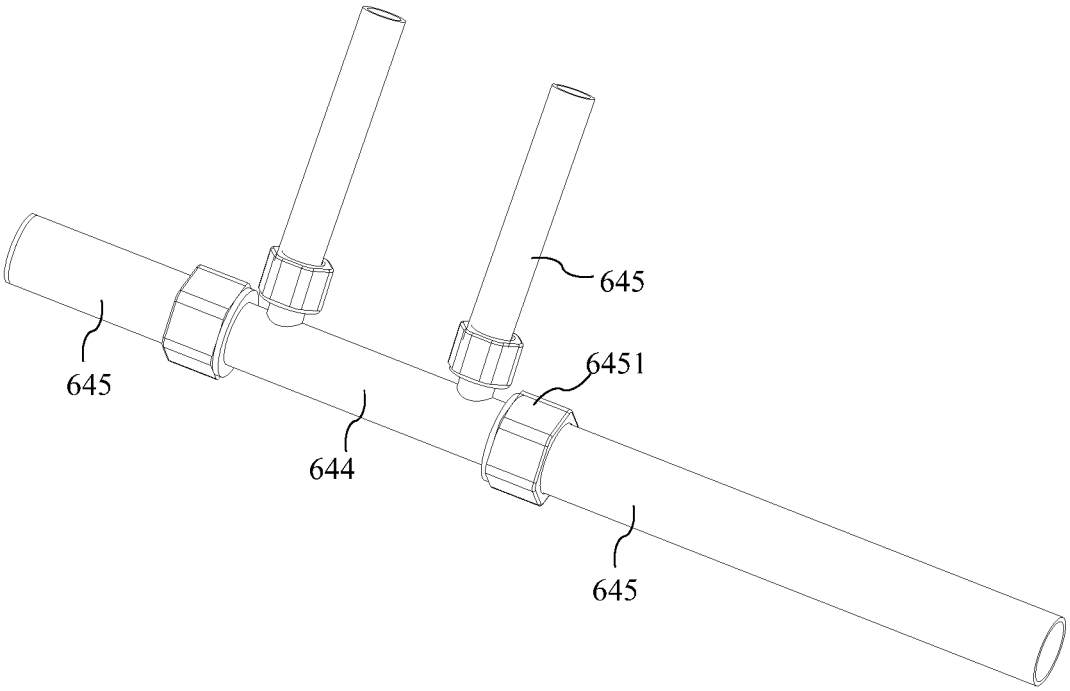
FIG. 29 illustrates a third perspective view of the pipeline assembly in the pool body according to the embodiment of the present invention.
Figure 30:
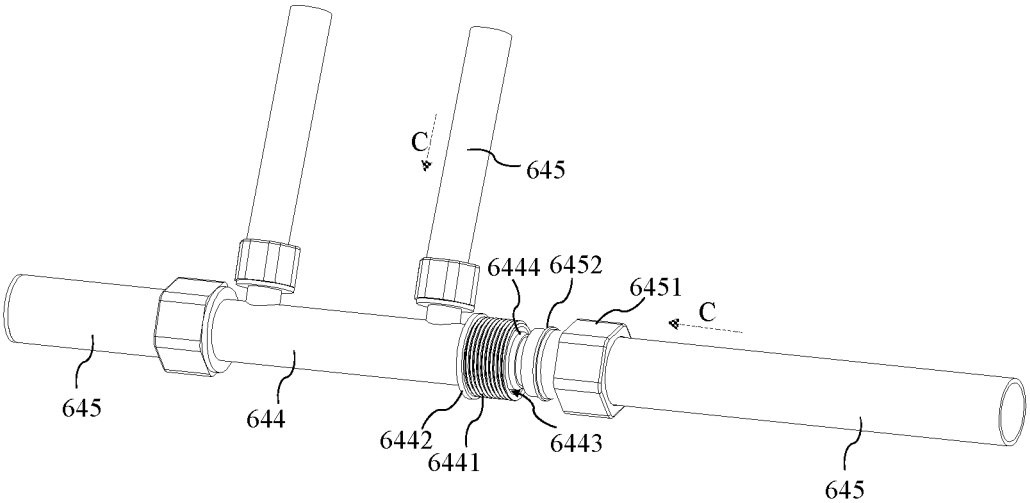
FIG. 30 illustrates an exploded perspective view of the pipeline assembly in the pool body according to the embodiment of the present invention.

In some possible embodiments, with reference to FIGS. 26-28, a water inlet division pipe is arranged between the soft pool body 20 and the hard pool body receiving cavity 11. Exemplarily, there is an annular cavity between the bottom of the soft pool body 20 and the bottom of the hard pool body receiving cavity 11, and the water inlet division pipe is disposed in the annular cavity of the soft pool body 20 and the hard pool body receiving cavity 11. That is, the water inlet division pipe in the pipeline assembly 60 is hidden in the bathtub, which appears beautiful. Exemplarily, the water inlet division pipe includes a plurality of multiway hard pipes 644 and 643 and hoses 645, the adjacent multiway hard pipes 644 and 643 are connected by one of the hoses 645, and each multiway hard pipe 644 is provided with a plurality of nozzles 65. Exemplarily, each hose 645 is a TPU hose or a silicone hose.

Thus, the pipeline assembly is built-in between the outer frame 10 and the soft pool body 20 of the bathtub. The pipeline layout between the outer frame 10 and the soft pool body 20 is achieved so that after filling with water, the pipeline assembly does not push against the fences, causing the fences to bulge.

Exemplarily, each multiway hard pipe 644 is a four-way hard pipe, hoses 645 are connected to both ends thereof, and two nozzles 65 are connected through hoses 645. Four multiway hard pipes 644, and eight nozzles 65 are shown in FIG. 27. However, the present application does not limit the number of the multiway hard pipes 644. By spraying water to a user through the plurality of the nozzles 65, the user has good use experience.

In some possible embodiments, with reference to FIGS. 29 to 33, a waterproof structure is disposed between each hard pipeline and the corresponding soft pipeline in the present application. For example, a waterproof structure is disposed between each hard pipeline and the corresponding soft pipeline in the heating water inlet pipeline 61, the nozzle water inlet pipeline, the heating water outlet pipeline 63, and the nozzle water outlet pipeline 62 shown in FIG. 27. As another example, waterproof structures are disposed between the multiway hard pipes 644 and 643 and the hoses 645 of the water inlet division pipe, and a waterproof structure is disposed between each nozzle 65 and the corresponding multiway hard pipe 644.

Figure 31:
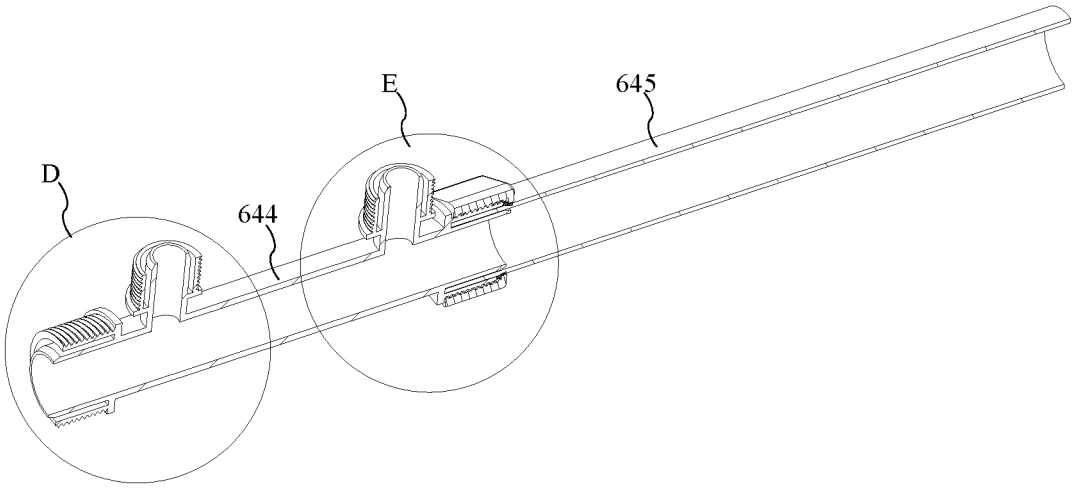
FIG. 31 illustrates a cross-sectional view of the pipeline assembly in the pool body according to the embodiment of the present invention.
Figure 32:
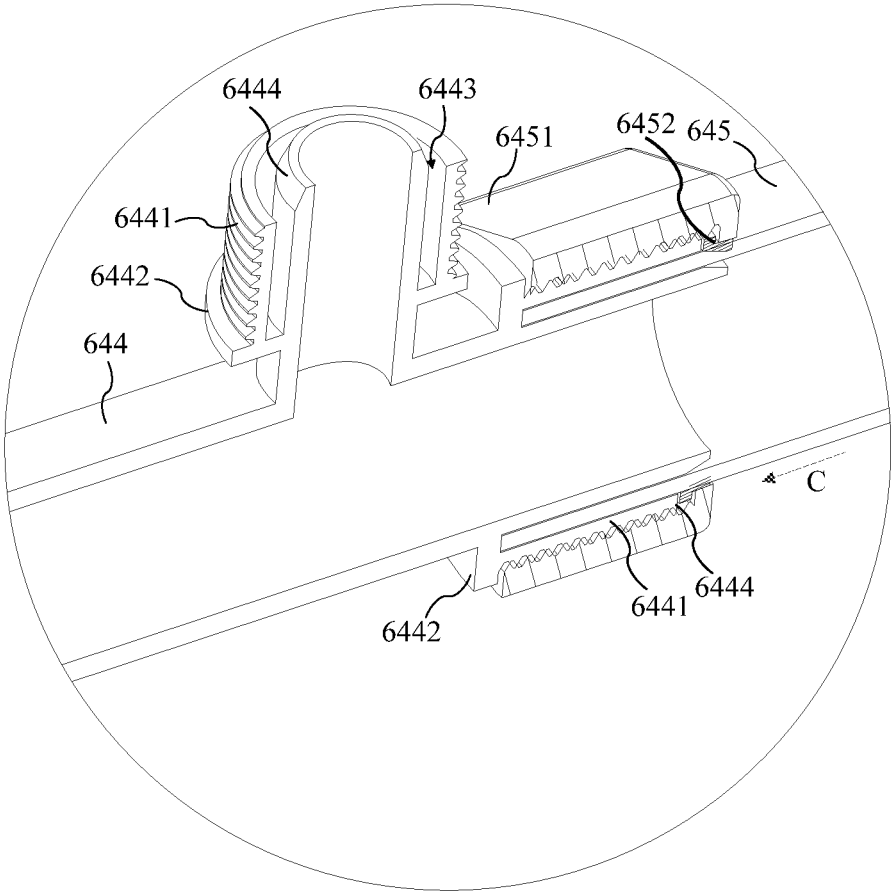
FIG. 32 shows an enlarged view of a portion E in FIG. 31.
Figure 33:
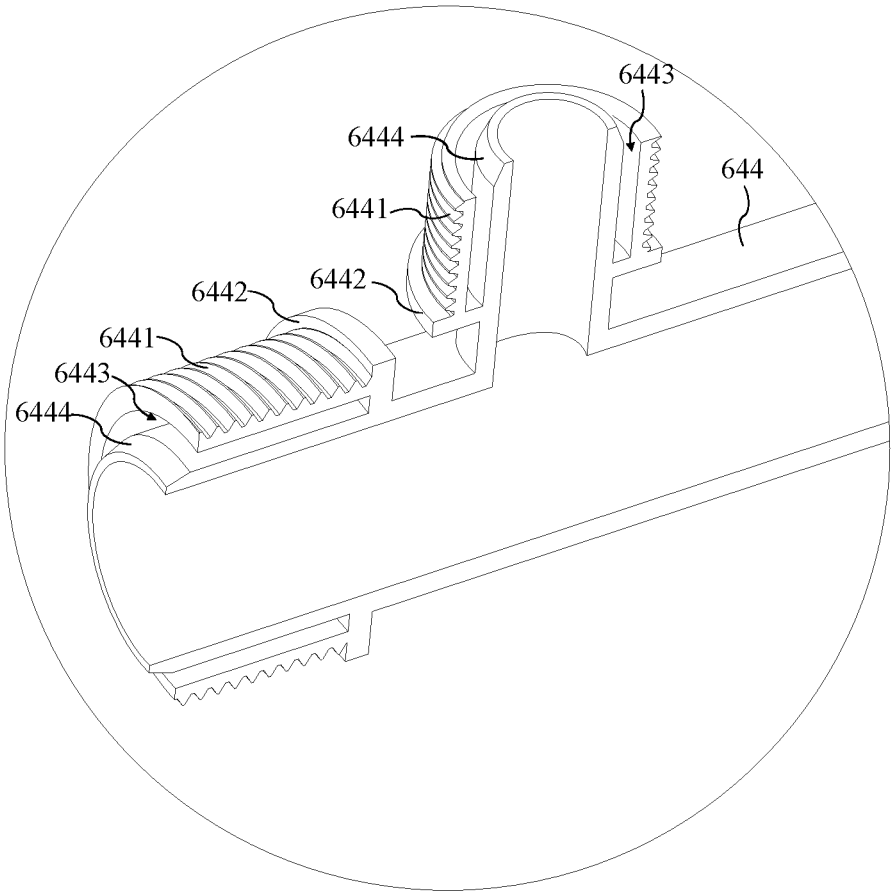
FIG. 33 shows an enlarged view of a portion D in FIG. 31.

By taking the waterproof structures in the water inlet division pipe as an example, other waterproof structures in the pipeline assembly 60 (e.g., the water outlet pipeline) are the same as the waterproof structures in the water inlet division pipe. Wherein an end where each hard pipe 644 is connected with the corresponding hose 645 in the water inlet division pipe is provided with an external thread structure 6441 surrounding a water inlet port of the hard pipe 644, and each external thread structure 6441 is connected with the corresponding hard pipe 644 through a limit stop 6442, and exemplarily, each limit stop 6442 is perpendicular to the corresponding hard pipe 644. Each limit stop 6442, the corresponding external thread structure 6441, and the corresponding hard pipe 644 enclose a waterproof cavity 6443 with an end opened. As shown in FIGS. 31 to 33, four waterproof cavities 6443 are formed in the multiway hard pipes 644 of the water inlet division pipe.

An outer periphery of each hose 645 is sleeved with a tapered press ring 6452 and a locking nut 6451, and each hose 645 is inserted into the corresponding waterproof cavity 6443. The insertion direction of each hose 645 is shown in a direction C in FIG. 30 and FIG. 32. Each locking nut 6451 is threadably connected to the corresponding external thread structure 6441, and the corresponding tapered press ring 6452 is positioned between the end of the corresponding external thread structure 6441 and the corresponding locking nut 6451 in the insertion direction of each hose 645, and each tapered press ring 6452 and the end of the corresponding hard pipe 644 clamp the corresponding hose 645 in the insertion direction. Exemplarily, a cap nut of each locking nut 6451 will drive the corresponding tapered press ring 6452 to move toward the corresponding hard pipe 644 in the insertion direction in the process of being threadably connected to the corresponding external thread structure 6441. When each locking nut 6451 is fully connected with the corresponding external thread structure 6441, the corresponding tapered press ring 6452 clamps the corresponding hose 645 just together with the end of the corresponding hard pipe 644. That is, a stroke of each locking nut 6451 on the corresponding external thread structure 6441 causes the corresponding tapered press ring 6452 to clamp the corresponding hose 645 just together with the end of the corresponding hard pipe 644.

Compared with the current industry where the waterproof function is realized by gluing, sealing ring configuration, and hose clamp locking, the present application achieves the waterproof function by a pure mechanical connection structure. The hard tapered press rings 6452 on the hoses 645 (TPU hoses or silicone hoses) are pressed against the ends of the hard pipes 644 in the insertion direction by screwing the locking nuts 6451, and the tapered press rings 6452, the hoses 645, the ends of the hard pipes 644 and the locking nuts 6451 are connected to each other to achieve waterproofing.

In some possible embodiments, the end of each hard pipe 644 has a tapered surface 6444, and each tapered press ring 6452 and the corresponding tapered surface 6444 clamp the corresponding soft pipeline in the insertion direction. That is, each tapered press ring 6452 and the tapered surface 6444 of the end of the corresponding hard pipe 644 cooperate to jointly clamp the corresponding soft pipeline in the insertion direction, improving the waterproof performance. The tapered surface 6444 at the end of each hard pipe 644 may also function to guide the insertion of the corresponding hose 645 into the corresponding waterproof cavity 6443.

Although the present invention has been illustrated and described with reference to some preferred embodiments of the present invention, those of ordinary skill in the art should understand that the above content is a further detailed description of the present invention in conjunction with the specific embodiments, and it cannot be considered that the specific implementations of the present invention are only limited to these descriptions. Those skilled in the art may make various changes in forms and details, including making several simple deductions or substitutions, without departing from the spirit and scope of the present invention.

The invention claimed is:

1. A bathtub comprising:

a hard pool body receiving cavity extending in a longitudinal direction and enclosed by a plurality of fences detachably connected in at least one of a circumferential direction and the longitudinal direction, wherein the circumferential direction surrounds the longitudinal direction; and a soft pool body comprising a water receiving cavity and a connecting portion, wherein:

the water receiving cavity extends along the longitudinal direction, a longitudinal top end of the water receiving cavity defines an opening, the connecting portion extends outwardly from the longitudinal top end of the water receiving cavity, the hard pool body receiving cavity receives the water receiving cavity of the soft pool body, the connecting portion of the soft pool body is detachably connected to a longitudinal top end of the hard pool body receiving cavity, the plurality of the fences comprises a first fence, a second fence, a third fence, and a fourth fence which are sequentially distributed along the circumferential direction, the first fence and the third fence respectively extend along a first direction and are disposed at an interval along a second direction, and the first direction and the second direction are respectively perpendicular to the longitudinal direction, the second fence and the fourth fence respectively extend along the second direction and are disposed at an interval along the first direction, in the first direction, one longitudinal end of the first fence and one longitudinal end of the second fence are detachably connected by a first corner beam, another longitudinal end of the first fence and one longitudinal end of the fourth fence are detachably connected by a second corner beam, the first corner beam and the second corner beam extend along the longitudinal direction, respectively, in the first direction, one longitudinal end of the third fence and another longitudinal end of the second fence are detachably connected by a third corner beam, another longitudinal end of the third fence and another longitudinal end of the fourth fence are detachably connected by a fourth corner beam, and the third corner beam and the fourth corner beam extend along the longitudinal direction, respectively.

2. The bathtub according to claim 1, wherein:

each one of the plurality of fences is made of plastic wood or wood;

the soft pool body is made of PVC or net clamping PVC.

3. The bathtub according to claim 1, wherein:

the first direction, the second direction, and the longitudinal direction are perpendicular to each other;

each of the plurality of fences comprises: an upper transverse beam, a lower transverse beam, a connecting plate, and a plurality of vertical beams;

the upper transverse beam and the lower transverse beam are disposed at an interval along the longitudinal direction and extend in a direction perpendicular to the longitudinal direction, respectively;

the plurality of the vertical beams extend along the longitudinal direction, respectively, and are connected with the upper transverse beam and the lower transverse beam, respectively; and the connecting plate extends in the same direction as the upper transverse beam and the lower transverse beam, is located between the upper transverse beam and the lower transverse beam in the longitudinal direction, and is connected to the upper transverse beam, the lower transverse beam, and the plurality of vertical beams.

4. The bathtub according to claim 3, wherein:

vertical beams of the plurality of vertical beams that are disposed at both longitudinal ends of each of the plurality of fences are detachably connected to corresponding corner beams of the first, second, third, and fourth corner beams, respectively;

each of the plurality of vertical beams is a hollow structure, a first blocking block is received at one longitudinal end of each of the plurality of vertical beams, and the upper transverse beam of at least one of the plurality of fences is connected to the vertical beams of the plurality of vertical beams by the first blocking block.

5. The bathtub according to claim 4, wherein an outer circumferential surface of the first blocking block includes anti-slip structures in a protruding manner for abutting against an inner wall of the corresponding one of the plurality of vertical beams after the first blocking block is placed in the corresponding one of the plurality of vertical beams, and no relative movement of the first blocking block and the corresponding one of the plurality of vertical beams in the longitudinal direction occurs when no external force is applied to the first blocking block.

6. The bathtub according to claim 5, wherein the first blocking block is in concave-convex fit with the inner wall of the corresponding one of the plurality of vertical beams; and the first blocking block is fixedly connected to the inner wall of the corresponding one of the plurality of vertical beams at a concave-convex fit position by screws.

7. The bathtub according to claim 3, wherein the upper transverse beam of each of the plurality of fences is in concave-convex fit with the connecting portion of the soft pool body.

8. The bathtub according to claim 1, further comprising: positioning members, wherein:

each one of the first, second, third, and fourth corner beams includes one of the positioning members, each positioning member includes a positioning post in a protruding manner, and a portion, corresponding to each one of the first, second, third, and fourth corner beams, of the connecting portion of the soft pool body sleeves the corresponding positioning post.

9. The bathtub according to claim 8, wherein:

each one of the first, second, third, and fourth corner beams is a hollow structure, each positioning member comprises a tubular structure and each tubular structure is inserted into the corresponding one of the first, second, third, and fourth corner beams;

each positioning member further comprises a first extension extending toward and fixedly connected to one of a plurality of grooves of an adjacent upper transverse beam, and a second extension extending toward and fixedly connected to another one of the plurality of grooves of the adjacent upper transverse beam.

10. The bathtub according to claim 9, wherein each positioning member further comprises a third extension that is clamped between adjacent fences of the plurality of fences.

11. The bathtub according to claim 8, wherein each positioning post includes a connecting hole for being fixedly connected with a cover plate assembly for covering the connecting portion of the soft pool body.

12. The bathtub according to claim 11, wherein the cover plate assembly comprises:

a first cover plate, a second cover plate, a third cover plate, and a fourth cover plate which are sequentially distributed along the circumferential direction;

wherein:

the first cover plate and the third cover plate extend along the first direction, respectively, the second cover plate and the fourth cover plate extend along the second direction, respectively, the first cover plate covers an upper transverse beam of the first fence, the second cover plate covers an upper transverse beam of the second fence, the third cover plate covers an upper transverse beam of the third fence, the fourth cover plate covers an upper transverse beam of the fourth fence;

in the first direction, one end of the first cover plate and one end of the second cover plate are detachably connected through a first transition piece, and another end of the first cover plate and one end of the fourth cover plate are detachably connected through a second transition piece;

in the first direction, one end of the third cover plate and another end of the second cover plate are detachably connected through a third transition piece, and another end of the third cover plate and another end of the fourth cover plate are detachably connected through a fourth transition piece;

the first transition piece covers the positioning member of the first corner beam, and is fixedly connected with a connecting hole in the positioning post of the first corner beam;

the second transition piece covers the positioning member of the second corner beam, and is fixedly connected with a connecting hole in the positioning post of the second corner beam;

the third transition piece covers the positioning member of the third corner beam, and is fixedly connected with a connecting hole in the positioning post of the third corner beam; and the fourth transition piece covers the positioning member of the fourth corner beam, and is fixedly connected with a connecting hole in the positioning post of the fourth corner beam.

13. The bathtub according to claim 12, wherein each of the first, second, third, and fourth cover plates is connected with the corresponding transition piece in an insertion manner.

14. The bathtub according to claim 13, wherein:

both ends of each of the first, second, third, and fourth cover plates are provided with an insertion hole, each transition piece of the first, second, third, and fourth transition pieces includes a first insertion portion and a second insertion portion, each first insertion portion is inserted into one of the insertion holes of the adjacent one of the first, second, third, and fourth cover plates, and each second insertion portion is inserted into the other insertion hole of the insertion holes of the adjacent one of the first, second, third, and fourth cover plates.

15. The bathtub according to claim 14, wherein:

a surface of each first insertion portion and a surface of each second insertion portion include a second detachment prevention portion for abutting against an inner wall of the corresponding insertion hole after each of the first and second insertion portions is inserted into the corresponding insertion hole, and no relative movement of each of the first and second insertion portions and the corresponding insertion hole in an insertion direction occurs when no external force is applied to each second detachment prevention portion.

16. The bathtub according to claim 1, further comprising a pipeline assembly for water inlet and drainage, wherein at least a portion of the pipeline assembly is received between the soft pool body and the hard pool body receiving cavity.

17. The bathtub according to claim 16, wherein:

the pipeline assembly comprises a water inlet pipeline and a water outlet pipeline;

one end of the water inlet pipeline is connected to the soft pool body, and another end of the water inlet pipeline is connected to a control box;

one end of the water outlet pipeline is connected to the soft pool body, and the other end of the water outlet pipeline is connected to the control box;

the water inlet pipeline comprises a soft water inlet pipeline, a first hard water inlet pipeline, and a second hard water inlet pipeline which are located at two ends of the soft water inlet pipeline, the first hard water inlet pipeline is connected to the soft pool body, and the second hard water inlet pipeline is connected to the control box;

the water outlet pipeline comprises a soft water outlet pipeline, a first hard water outlet pipeline, and a second hard water outlet pipeline which are located at two ends of the soft water outlet pipeline, and the first hard water outlet pipeline is connected to the soft pool body, and the second hard water outlet pipeline is connected to the control box.

18. The bathtub according to claim 17, wherein:

the soft water inlet pipeline or the soft water outlet pipeline includes a hard support structure; or a water inlet division pipe is arranged between the soft pool body and the hard pool body receiving cavity, a water inlet branch pipe comprises a plurality of multiway hard pipes and hoses, adjacent multiway hard pipes of the plurality of multiway hard pipes are connected by one of the hoses, and each multiway hard pipe of the plurality of multiway hard pipes includes a plurality of nozzles.

19. The bathtub according to claim 16, wherein:

the pipeline assembly comprises hard pipelines and soft pipelines, an end where each hard pipeline is connected to a corresponding soft pipeline includes an external thread structure surrounding the hard pipeline, each external thread structure is connected to the corresponding hard pipeline through a limit stop, each limit stop, the corresponding external thread structure, and the corresponding hard pipeline enclose a waterproof cavity having an open end;

an outer periphery of each soft pipeline is sleeved with a tapered press ring and a locking nut, each soft pipeline is inserted into the corresponding waterproof cavity, each locking nut is threadably connected to the corresponding external thread structure, in an insertion direction of each soft pipeline, the corresponding tapered press ring is located between an end of the corresponding external thread structure and the corresponding locking nut, and each tapered press ring and an end of the corresponding hard pipeline clamp the corresponding soft pipeline in the insertion direction.

* * * * *